US007647226B2

(12) United States Patent
Sato

(10) Patent No.: US 7,647,226 B2
(45) Date of Patent: Jan. 12, 2010

(54) APPARATUS AND METHOD FOR CREATING PITCH WAVE SIGNALS, APPARATUS AND METHOD FOR COMPRESSING, EXPANDING, AND SYNTHESIZING SPEECH SIGNALS USING THESE PITCH WAVE SIGNALS AND TEXT-TO-SPEECH CONVERSION USING UNIT PITCH WAVE SIGNALS

(75) Inventor: Yasushi Sato, Nagareyama (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 102 days.

(21) Appl. No.: 11/715,937

(22) Filed: Mar. 9, 2007

(65) Prior Publication Data

US 2007/0174056 A1 Jul. 26, 2007

Related U.S. Application Data

(62) Division of application No. 10/415,437, filed on Apr. 29, 2003.

(51) Int. Cl.
*G10L 13/00* (2006.01)
*G10L 11/04* (2006.01)

(52) U.S. Cl. ..... 704/260; 704/207

(58) Field of Classification Search ..... 704/260, 704/207

See application file for complete search history.

(56) References Cited

U.S. PATENT DOCUMENTS 5,430,241 A 7/1995 Furuhashi et al.
5,832,425 A 11/1998 Mead
5,933,808 A 8/1999 Kang et al.
5,942,709 A 8/1999 Szalay
5,987,413 A * 11/1999 Dutoit et al. ..... 704/267
6,405,169 B1 * 6/2002 Kondo et al. ..... 704/258
6,665,641 B1 * 12/2003 Coorman et al. ..... 704/260
6,980,955 B2 * 12/2005 Okutani et al. ..... 704/258

FOREIGN PATENT DOCUMENTS

EP 0 248 593 12/1987

(Continued)

OTHER PUBLICATIONS

International Search Report, Mailed Nov. 12, 2002.

(Continued)

*Primary Examiner*—Talivaldis Ivars Smits
(74) *Attorney, Agent, or Firm*—Eric J. Robinson; Robinson Intellectual Property Law Offices, P.C.

(57) ABSTRACT

A pitch wave signal creation method as a preliminary process for efficiently coding a speech wave signal having a fluctuated pitch period is provided. A speech signal compressing/expanding apparatus and a speech signal synthesizing apparatus using the method, and a signal processing associated therewith are further provided. The pitch wave creation method of the invention is essentially comprised of a method of detecting the instantaneous pitch period of each pitch wave element of the speech wave signal, and a process of converting a corresponding pitch wave element into a normalized pitch wave element having a predetermined fixed time length by expanding and compressing the pitch wave element on a time axis while retaining its wave pattern based on the each detected instantaneous pitch period. The speech signal having a pitch fluctuation can be compressed in high quality and high efficiency by coding or synthesizing the speech wave signal using the pitch wave signal creation method of the invention. Text-to-speech conversion using pitch wave signals.

4 Claims, 9 Drawing Sheets

FOREIGN PATENT DOCUMENTS

| | | |
|---|---|---|
| EP | 0 666 557 | 8/1995 |
| EP | 0 749 107 | 12/1996 |
| EP | 0 848 372 | 6/1998 |
| EP | 0 853 309 | 7/1998 |
| EP | 1 039 442 | 9/2000 |
| EP | 1 102 240 | 5/2001 |
| EP | 1 422 693 | 5/2004 |
| JP | 58-098798 | 6/1983 |
| JP | 58-188000 | 11/1983 |
| JP | 59-077498 | 5/1984 |
| JP | 63-124100 | 5/1988 |
| JP | 02-066598 | 3/1990 |
| JP | 02-140020 | 5/1990 |
| JP | 03-080300 | 4/1991 |
| JP | 03-288199 | 12/1991 |
| JP | 05-265499 | 10/1993 |
| JP | 07-129196 | 5/1995 |
| JP | 09-081188 | 3/1997 |
| JP | 10-149187 | 6/1998 |
| JP | 11-327594 | 11/1999 |
| WO | WO 99/59138 | 11/1999 |
| WO | WO 00/65572 | 11/2000 |
| WO | WO 02/097798 | 12/2002 |

OTHER PUBLICATIONS

Supplementary Partial European Search Report dated Jan. 19, 2007 for Application No. 02765393.0.

L.M. Arslan, *Speaker Transformation Algorithm Using Segmental Codebooks*, Speech Communication, Elsevier Science Publishers, Amsterdam, NL, vol. 28, No. 3, Jul. 1999, pp. 211-226.

E. Moulines et al., *Non-Parametric Techniques for Pitch-Scale and Time-Scale Modification of Speech*, Speech Communication, Elsevier Science Publishers, Amsterdam, NL, vol. 16, No. 2, Feb. 1995, pp. 175-205.

Supplementary European Search Report for Application No. 02765393.0 dated Apr. 23, 2007.

L.M. Arslan, *Speaker Transformation Algorithm Using Segmental Codebooks* (*STASC*)[1], Speech Communication, Elsevier Science Publishers, Amsterdam, NL, vol. 28, No. 3, Jul. 1999, pp. 211-226.

W. Bastiaan Kleijn et al., *Waveform Interpolation Coding with Pitch-Spaced Subbands*, Proc. International Conf. Speech and Language Process, Oct. 1998, p. 1069 (4 pages).

Written Notification of Reasons for Refusal dated Nov. 10, 2006 for Application No. 2002-277749.

Written Notification of Reasons for Refusal dated Nov. 10, 2006 for Application No. 2002-277769.

Written Notification of Reasons for Refusal dated May 10, 2007 for Application No. 2003-522907.

European Search Report (Application No. 07003891.4) dated Aug. 21, 2007.

Y. Ishikawa et al., *Speech Synthesis Software for a 32-Bit Microprocessor*, Consumer Electronics, IEEE Transactions on, vol. 44, No. 3, Aug. 1998, pp. 1173-1182.

* cited by examiner

APPARATUS AND METHOD FOR CREATING PITCH WAVE SIGNALS, APPARATUS AND METHOD FOR COMPRESSING, EXPANDING, AND SYNTHESIZING SPEECH SIGNALS USING THESE PITCH WAVE SIGNALS AND TEXT-TO-SPEECH CONVERSION USING UNIT PITCH WAVE SIGNALS

TECHNICAL FIELD

The present invention relates to an apparatus and a method for creating pitch wave signals. Also, the present invention relates to a speech signal compressing apparatus, a speech signal expanding apparatus, a speech signal compression method and a speech signal expansion method using such a method for creating pitch wave signals.

In addition, the present invention relates to a speech synthesizing apparatus, a speech dictionary creating apparatus, a speech synthesis method and a speech dictionary creation method using such a method for creating pitch wave signals.

BACKGROUND ART

In recent years, techniques for compressing speech signals have been used frequently in speech communication using cellular phones and the like. Specific application areas include mainly CODEC (COder/DECoder), speech recognition and speech synthesis.

Methods for compressing speech signals are broadly classified as methods using human acoustic functions and methods using characteristics of vocal bands.

The methods using acoustic functions include MP3 (MPEG1 audio layer 3), ATRAC (Adaptive TRansform Acoustic Coding) and AAC (Advanced Audio Coding). The method using acoustic functions is characterized in that sound quality is high although the compressibility ratio is low, and is often used for compressing music signals.

On the other hand, the method using characteristics of vocal bands is a method that is used for compressing a speech sound, and is characterized in that the compressibility ratio is high although sound quality is low. The methods using characteristics of vocal bands include methods using linear prediction coding, specifically CELP and ADPCM (Adaptive Differential Pulse Code Modulation).

In the case where the speech sound is compressed by the method using linear prediction coding, generally a pitch of the speech sound (inverse of a fundamental frequency) should be extracted for performing linear prediction coding. For this purpose, previously, the pitch has been extracted using methods using Fourier transformation such as cepstrum analysis.

In the case where the pitch is extracted by the method using Fourier transformation, the fundamental frequency is selected from frequencies at which spectrum peaks occur, and the inverse of the fundamental frequency is identified as a pitch.

The spectrum can be obtained by carrying out the FFT (Fast Fourier Transform) operation and the like. For obtaining the spectrum by the FFT operation, generally sampling of the speech sound should be carried out over a time period longer than that equivalent to one pitch of the speech sound.

The longer the time period over which sampling of the speech sound is carried out, the higher is the possibility that a steep change in wave is caused due to the switching of the speech sound and the like while the sampling is continuously carried out. If the steep change in wave occurs while the sampling is carried out, an error included in the pitch frequency to be identified in processing subsequent to the sampling will be significant.

In addition, fluctuations are included in the length of the pitch of human voice. This fluctuation may cause the error in the pitch frequency. That is, the speech sound including fluctuations is sampled over a time period equivalent to several pitches, and as a result, the fluctuations are evened, and thus the identified pitch frequency is different from an actual pitch frequency including fluctuations.

If the speech signal is compressed based on the pitch value with fluctuations evened, not only a machinery speech sound is produced but also sound quality is reduced when the speech signal is expanded and played back.

The present invention has been devised in view of the above situations, and has as its first object provision of a pitch wave signal creating apparatus and a pitch wave signal creation method effectively functioning as preliminary processing for efficiently coding a speech wave signal including pitch fluctuations.

Next, in recent years, terminals for performing digital speech communications such as cellular phones have been widely used.

There are cases where such terminals are used for communications with the speech signal compressed using the method of LPC (Linear Prediction Coding) such as CELP (Code Excited Linear Prediction).

In the case where the method of linear prediction coding is used, the speech sound is compressed by coding the vocal tract characteristic (frequency characteristic of vocal tract) of human voice. For playing back the speech sound, a table having this code as a key is searched.

When this method is applied for cellular phones and the like, however, sound quality is often reduced, thus making it difficult to recognize the voice of a speech communication partner if the number of codes is small.

For improving sound quality in the method of linear prediction coding, the number of elements of the vocal tract characteristic registered in the table may be increased. In the method of increasing the number of the elements, however, both the amount of data to be transmitted and the amount of data in the table are considerably increased. Therefore, the efficiency of compression is compromised, and it is difficult to store the table in a terminal capable of bearing only small apparatus.

In addition, the actual vocal tract of human being has a very complicated structure, and the frequency characteristic of the vocal tract fluctuates with time. Thus, the pitch of the speech sound has fluctuations. Therefore, even though human voice is simply subjected to Fourier transformation, the characteristic of the vocal tract cannot be accurately determined. Thus, if linear prediction coding is carried out using the characteristic of the vocal tract determined based on the result of simply subjecting human voice to Fourier transformation, sound quality cannot be satisfactorily improved even though the number of elements of the table is increased.

This invention has been devised in view of the above situations, and has as its second object provision of a speech signal compressing/expanding apparatus and a speech signal compression/expansion method for efficiently compressing data representing a speech sound or compressing data representing a speech sound having fluctuations in high sound quality.

In addition, methods for synthesizing a speech sound include so called a rule synthesis method. The rule synthesis method is a method in which pitch information and spectrum envelope information (vocal tract characteristic) are determined based on information obtained as a result of morphological analysis of a text and rhythm prediction coding, and a speech sound reading this text is synthesized based on the determination result.

Specifically, as shown in FIG. 8 for example, a text for which a speech sound is synthesized is first subjected to morphological analysis (step S101 in FIG. 8), a row of pronouncing symbols showing the pronounce of the speech sound reading the text is created based on the result of the morphological analysis (step S102), and a row of rhythm symbols showing the rhythm of this speech sound is created (step S103).

Then, the envelope of the spectrum of the speech sound is determined based on the obtained row of pronounce symbols (step S104), the characteristic of a filter simulating the characteristic of the vocal tract is determined based on this envelope. On the other hand, a sound source parameter showing the characteristic of the sound produced by the vocal band is created based on the obtained row of rhythm symbols (step S105), and a sound source signal showing the wave of the sound produced by the vocal band is created based on the sound source parameter (step S106).

Then, this sound source signal is filtered by the filter determining the characteristic (step S107), whereby the speech sound is synthesized.

For synthesizing the speech sound, the sound source signal is simulated by switching between an impulse row generated by an impulse row source 1 and a white noise generated by a white noise source 2 as shown in FIG. 9. Then, this sound source signal is filtered by a digital filter 3 simulating the characteristic of the vocal tract to create the speech sound.

However, the actual vocal band of human being has a complicated structure, and makes it difficult to show the characteristic of the vocal band by the impulse row. Therefore, the speech sound synthesized by the above described rule synthesis method tends to be a machinery speech sound dissimilar to the actual speech sound produced by man.

Also, the structure of the vocal tract is complicated, and thus it is difficult to accurately predict the spectrum envelope, and hence it is difficult to show the characteristic of the vocal tract by the digital filter. This is also a cause of reduction in sound quality of the speech sound synthesized by the rule synthesis method.

This invention has been devised in view of the above situations, and has as its third object provision of a speech synthesizing apparatus, a speech dictionary creating apparatus, a speech synthesis method and a speech dictionary creation method for efficiently synthesizing natural speech sounds.

DISCLOSURE OF THE INVENTION

For achieving the above three types of objects of the invention, the present invention is classified broadly into three types. Those three types of inventions are hereinafter referred to as the first invention, second invention and third invention, respectively, for convenience.

The outlines of these inventions will be described in order below.

First Invention

For achieving the object of the first invention, the pitch wave signal creating apparatus according to the first invention is essentially comprised of:

means for detecting an instantaneous pitch period of each pitch wave element of a speech wave signal; and means for converting a corresponding pitch wave element into a normalized pitch wave element having a predetermined fixed time length by expanding and compressing the pitch wave element on a time axis while retaining its wave pattern based on the detected instantaneous pitch period. In addition, in another aspect, the pitch wave signal creating apparatus according to the present invention is comprised of:

means for detecting an average pitch period in a certain time interval of a speech wave signal;

a variable filter filtering the speech wave signal while having the frequency characteristics varied in accordance with the detected average pitch period;

means for detecting the instantaneous pitch period of the speech wave signal based on the output of the variable filter;

means for extracting a corresponding pitch wave element based on the detected individual instantaneous pitch period; and means for converting the extracted pitch wave element into a pitch wave element having a predetermined fixed time length by expanding and compressing the pitch wave length on the time axis.

According to this configuration of the present invention, if a speech wave signal such that the pitch period of a voiced sound produced is changed on every instant (fluctuates with time) is provided, the individual pitch wave element in the speech wave is converted into a normalized pitch wave element having a fixed time length. By this normalization processing (according to the present invention) for the speech pitch wave element, a speech wave such that a plurality of wave elements having the almost same pattern are continuously repeated is obtained. In this way, in the speech wave in which changes in pattern are uniformalized, the correlation among individual pitch waves is improved, and therefore it is expected that substantial information compression can be performed by subjecting the pitch wave to entropy coding. Here, the entropy coding refers to a high efficiency coding (information compression) mode in which with attention given to a probability of occurrence of each sampled specimen, codes having a small number of bits are given to specimens of high probability occurrence. According to the entropy coding, specimens of high probability of occurrence are given codes having a small number of bits and coded with attention given to the probability of occurrence of specimens. If entropy coding is used, information from a source of information having an unbalanced occurrence probability can be coded with a smaller amount of information compared to equal-length coding. A typical example of application of entropy coding is DPCM (differential pulse code modulation).

As described above, according to the above configuration of the present invention, the changes in pitch wave elements are uniformalized due to their normalization, and therefore the degree of correlation among individual wave elements is increased. Therefore, if a difference between neighboring pitch wave elements is determined, and the difference is coded, coded bit efficiency can be improved. This is because the dynamic range of a differential signal of difference between signals having a high degree of correlation with each other is much smaller than the dynamic range for original signals, thus making it possible to considerably reduce the number of bits required for coding.

More specifically, the pitch wave signal creating apparatus according to the first invention comprises:

a variable filter having the frequency characteristics varied in accordance with control to filter a speech signal representing a speech wave, thereby extracting a fundamental frequency component of a speech sound;

a filter characteristic determining unit identifying the fundamental frequency of the above described speech sound based on the fundamental frequency component extracted by the above described variable filter, and controlling the above described variable filter so as to obtain frequency characteristics such that components other than those existing near the identified fundamental frequency are cut off;

pitch extracting means for dividing the above described speech signal into sections each constituted by a speech signal equivalent to a unit pitch based on a value of the fundamental frequency component of the speech signal; and a speech signal processing unit processing the speech signal into a pitch wave signal by making substantially identical the phase of the speech signal in the each above described section.

The above described speech signal processing unit may comprise a pitch length fixing unit making substantially identical the time length of the pitch wave signal in the each section by sampling (resampling) the pitch wave signal in the each above described section with substantially the same number of specimens.

The above described pitch length fixing unit may create and output data for identifying the original time length of the pitch wave signal in the each above described section.

The above described pitch wave signal creating apparatus may comprise an interpolation unit adding a signal for interpolating the pitch wave signal to the pitch wave signal sampled (resampled) by the above described pitch length fixing unit.

The above described interpolation unit may comprise:

means for carrying out interpolation of the same pitch wave signal by a plurality of methods to create a plurality of interpolated pitch wave signals; and means for creating a plurality of spectrum signals each representing the result of subjecting the each interpolated pitch wave signal to Fourier transformation, identifying the pitch wave signal with the least number of harmonic wave components out of the interpolated pitch wave signal based on the created spectrum signal, and outputting the identified pitch wave signal.

The above described filter characteristic determining unit may comprise a cross detecting unit identifying a period in which the fundamental frequency component extracted by the above described variable filter reaches a predetermined value, and identifying the above described fundamental frequency based on the identified period.

The above described filter characteristic determining unit may comprise:

an average pitch detecting unit for detecting the pitch length of a speech sound represented by a speech signal before being filtered based on the speech signal; and a determination unit for determining whether there is a difference by a predetermined amount or larger between the period identified by the above described cross detecting unit and the pitch length identified by the above described average pitch detecting unit, and controlling the above described variable filter so as to obtain frequency characteristics such that components other than those existing near the fundamental frequency identified by the above described cross detecting unit are cut off if it is determined that there is not such a difference, and controlling the above described variable filter so as to obtain frequency characteristics such that components other than those existing near the fundamental frequency identified from the pitch length identified by the above described average pitch detecting unit is cut off if there is such a difference.

The above described average pitch detecting unit may comprise:

a cepstrum analyzing unit for determining a frequency at which the cepstrum of a speech signal before being filtered has a maximum value;

a self correlation analyzing unit for determining a frequency at which the periodgram of the self correlation function of the speech signal before being filtered has a maximum value; and an average calculating unit for determining the average of pitches of the speech sound represented by the speech signal based on the frequencies determined by the above described cepstrum analyzing unit and the above described self correlation analyzing unit, and identifying the determined average as the pitch length of the speech sound.

The above described average calculating unit may exclude frequencies having values equal to or smaller than a predetermined value, of the frequencies determined by the above described cepstrum analyzing unit and the above described self correlation analyzing unit, from objects of which averages are to be determined.

The above described speech signal processing unit may comprise an amplitude fixing unit for creating a new pitch wave signal representing the result obtained by multiplying the value of the above described pitch wave signal by a proportionality factor, thereby uniformalizing the amplitude of the new pitch signal so that effective values are substantially equal to one another.

The above described amplitude fixing unit may create and output data showing the above described proportionality factor.

In addition, from another viewpoint, the first invention is understood as a pitch wave signal creation method. This method comprises the steps of:

extracting fundamental frequency components of a speech sound by filtering a speech signal representing a wave of the speech sound using a variable filter with frequency characteristics varied in accordance with control;

identifying a fundamental frequency of the above described speech sound based on the fundamental frequency component extracted by the above described variable filter;

controlling the above described variable filter so as to obtain frequency characteristics such that components other than those existing near the identified fundamental frequency are cut off;

dividing the above described speech signal into sections each constituted by the speech signal equivalent to a unit pitch based on a value of the fundamental frequency component of the speech signal; and processing the speech signals into pitch wave signals by making substantially identical the phase of the speech signal in the each above described section.

Second Invention

For achieving the object of the second invention, the speech signal compressing apparatus according to the second invention is essentially comprised of:

means for detecting an instantaneous pitch period of each pitch wave element of a speech wave signal;

means for converting a corresponding pitch wave element into a normalized pitch wave element having a predetermined fixed time length by expanding and compressing the pitch wave element on a time axis while retaining its wave pattern based on the detected instantaneous pitch period; and coding means for individually coding the value of the instantaneous pitch period detected for the each pitch wave element and the signal representing the normalized pitch wave element having a fixed time period obtained by the conversion means.

The speech signal compressing apparatus of the present invention has the coding means configured to subject the normalized speech signal (i.e. speech sound constituted by pitch wave elements each having a fixed time length) to entropy coding in order to efficiently compress information of the signal taking advantage of the above characteristics brought about by the normalization of pitch wave elements.

More specifically, according to the first aspect, the speech signal compressing apparatus according to the second invention comprises:

speech signal processing means for obtaining a speech signal representing the wave of a first speech sound to be compressed, and making substantially identical the time lengths of sections each equivalent to a unit pitch of the speech signal, thereby processing the speech signal into a pitch wave signal;

sub-band extracting means for extracting a fundamental frequency component and a harmonic wave component of the above described first speech sound from the pitch wave signal;

retrieval means for identifying sub-band information having the highest correlation with variation with time in the fundamental frequency component and the harmonic wave component extracted by the above described sub-band extracting means, of sub-band information showing variation with time in the fundamental frequency component and harmonic wave component of a second speech sound for creating a difference;

differentiating means for creating a differential signal representing a difference between the wave of the above described first speech sound and the wave of the above described second speech sound represented by the sub-band information based on the above described speech signal and the sub-band information identified by the above described retrieval means; and output means for outputting an identification code for identifying the sub-band information identified by the above described retrieval means and the above described differential signal.

In addition, according to the second aspect, the speech signal compressing apparatus of the second invention comprises:

speech signal processing means for obtaining a speech signal representing the wave of a first speech sound to be compressed, and making substantially identical the time lengths of sections each equivalent to a unit pitch of the speech signal, thereby processing the speech signal into a pitch wave signal;

sub-band extracting means for extracting a fundamental frequency component and a harmonic wave component of the above described first speech sound from the pitch wave signal;

retrieval means for identifying sub-band information having the highest correlation with variation with time in the fundamental frequency component and the harmonic wave component extracted by the above described sub-band extracting means, of sub-band information showing variation with time in the fundamental frequency component and harmonic wave component of a second speech sound for creating a difference;

differentiating means for creating a differential signal representing a difference in fundamental frequency components and harmonic wave components between the above described first speech sound and the above described second speech sound based on the fundamental frequency component and the harmonic wave component of the above described first speech sound extracted by the above described sub-band extracting means and the sub-band information identified by the above described retrieval means; and output means for outputting an identification code for identifying the sub-band information identified by the above described retrieval means and the above described differential signal.

Speaker identifying data showing speech sound characteristics of a speaker of the second speech sound represented by the sub-band information may be brought into correspondence with the above described sub-band information, and the above described retrieval means may comprise characteristic identifying means for identifying characteristics of a speaker of the first speech sound based on the above described speech signal, the characteristic identifying means identifying information having the highest correlation with variation with time in the fundamental frequency component and the harmonic wave component extracted by the above described sub-band extracting means, of only information brought into correspondence with the speaker identifying data showing the characteristics identified by the above described characteristic identifying means.

The above described output means may determine whether or not the above described first speech sound is substantially identical to a third speech sound of which the fundamental frequency component and harmonic wave component are extracted before the extraction is carried out based on the fundamental frequency component and the harmonic wave component of the above described first speech sound, extracted by the above described sub-band extracting means, and may output data showing that the above described first speech sound is substantially identical to the above described third speech sound instead of the above described identification code and differential signal if it is determined that the above described first speech sound is substantially identical to the above described third speech sound.

The above described speech signal processing means may comprise means for creating and outputting pitch data for identifying the original time length of the pitch wave signal in the each above described section.

The above described speech signal processing means may comprise:

a variable filter having the frequency characteristics varied in accordance with control to filter the above described speech signal, thereby extracting a fundamental frequency component of the speech signal;

a filter characteristic determining unit identifying the fundamental frequency of the above described speech sound based on the fundamental frequency component extracted by the above described variable filter, and controlling the above described variable filter so as to obtain frequency characteristics such that components other than those existing near the identified fundamental frequency are cut off;

pitch extracting means for dividing the above described speech signal into sections each constituted by a speech signal equivalent to a unit pitch based on a value of the fundamental frequency component of the speech signal; and a pitch length fixing unit creating a pitch wave signal with time length in the each above described section being substantially identical by sampling the speech signal in the each above described section of the above described speech signal with substantially the same number of specimens.

The above described filter characteristic determining unit may comprise a cross detecting unit identifying a period in which the fundamental frequency component extracted by the above described variable filter reaches a predetermined value, and identifying the above described fundamental frequency based on the identified period.

The above described filter characteristic determining unit may comprise:

an average pitch detecting unit detecting the time length of the pitch of a speech sound represented by a speech signal before being filtered based on the speech signal; and a determination unit determining whether or not there is a difference by a predetermined amount or larger between the period identified by the above described cross detecting unit and the time length of the pitch identified by the above described average pitch detecting unit, and controlling the above described variable filter so as to obtain frequency characteristics such that components other than those existing near the fundamental frequency identified by the above described cross detecting unit are cut off if it is determined that there is not such a difference, and controlling the above described variable filter so as to obtain frequency characteristics such that components other than those existing near the fundamental frequency identified from the time length of the pitch identified by the above described average pitch detecting unit is cut off if there is such a difference.

The above described average pitch detecting unit may comprise:

a cepstrum analyzing unit determining a frequency at which the cepstrum of a speech signal before being filtered has a maximum value;

a self correlation analyzing unit determining a frequency at which the periodgram of the self correlation function of the speech signal before being filtered has a maximum value; and an average calculating unit determining the average of pitches of the speech sound represented by the speech signal based on the frequencies determined by the above described cepstrum analyzing unit and the above described self correlation analyzing unit, and identifying the determined average as the time length of the pitch of the speech sound.

Next, the speech signal expanding apparatus according to the second invention comprises:

input means for obtaining an identification code for specifying sub-band information showing variation with time in the fundamental frequency component and harmonic wave component of a first pitch wave signal created by making substantially identical the time lengths of sections each equivalent to the unit pitch of a speech signal representing the wave of a first speech sound, a differential signal representing a difference between the wave of a second speech sound to be restored and the wave of the above described first speech sound, and pitch data showing the time length of a section equivalent to the unit pitch of the above described second speech sound;

pitch wave signal restoring means for obtaining sub-band information identified by the identification code obtained by the above described input means, of the above described sub-band information, and restoring the first pitch wave signal based on the obtained sub-band information;

addition means for creating a second pitch wave signal representing the sum of the wave of the first pitch wave signal restored by the above described pitch wave signal restoring means and the wave represented by the above described differential signal; and speech signal restoring means for creating a speech signal representing the above described second speech sound based on the above described pitch data and the above described second pitch wave data.

In addition, the speech signal expanding apparatus according to another aspect comprises:

input means for obtaining an identification code for specifying sub-band information showing variation with time in the fundamental frequency component and harmonic wave component of a first pitch wave signal created by making substantially identical the time lengths of sections each equivalent to the unit pitch of a speech signal representing the wave of a first speech sound, a differential signal representing a difference in the fundamental frequency component and harmonic wave component between the wave of a second speech sound to be restored and the above described first speech sound, and pitch data showing the time length of a section equivalent to the unit pitch of the above described second speech sound;

sub-band information restoring means for obtaining sub-band information identified by the identification code obtained by the above described input means, of the above described sub-band information, and identifying the fundamental frequency component and the harmonic wave component of the above described second speech sound based on the obtained sub-band information and the above described differential signal; and speech signal restoring means for creating a speech signal representing the above described second speech sound based on the above described pitch data and the fundamental frequency component and the harmonic wave component of the above described second speech sound identified by the above described sub-band information restoring means.

Also, the second invention can be considered as a speech signal compression method, and in that case, the method comprises the steps of:

obtaining a speech signal representing the wave of a first speech sound to be compressed, and making substantially identical the time lengths of sections each equivalent to a unit pitch of the speech signal, thereby processing the speech signal into a pitch wave signal;

extracting a fundamental frequency component and a harmonic wave component of the above described first speech sound from the pitch wave signal;

identifying sub-band information having the highest correlation with variation with time in the fundamental frequency component and the harmonic wave component extracted by the above described sub-band extracting means, of sub-band information showing variation with time in the fundamental frequency component and harmonic wave component of a second speech sound for creating a difference;

creating a differential signal representing a difference between the wave of the above described first speech sound and the wave of the above described second speech sound represented by the sub-band information based on the above described speech signal and the identified sub-band information; and outputting an identification code for identifying the identified sub-band information and the above described differential signal.

In addition, an alternative of this speech signal compression method comprises the steps of:

obtaining a speech signal representing the wave of a first speech sound to be compressed, and making substantially identical the time lengths of sections each equivalent to a unit pitch of the speech signal, thereby processing the speech signal into a pitch wave signal;

extracting a fundamental frequency component and a harmonic wave component of the above described first speech sound from the pitch wave signal;

retrieval means for identifying sub-band information having the highest correlation with variation with time in the fundamental frequency component and the harmonic wave component extracted by the above described sub-band extracting means, of sub-band information showing variation with time in the fundamental frequency component and harmonic wave component of a second speech sound for creating a difference;

creating a differential signal representing a difference in the fundamental frequency component and harmonic wave component between the above described first speech sound and the above described second speech sound based on the fundamental frequency component and the harmonic wave component of the above described first speech sound and the identified sub-band information; and outputting an identification code for identifying the identified sub-band information and the above described differential signal.

In addition, the speech signal expansion method according to the second invention comprises the steps of:

obtaining an identification code for specifying sub-band information showing variation with time in the fundamental frequency component and harmonic wave component of a first pitch wave signal created by making substantially identical the time lengths of sections each equivalent to the unit pitch of a speech signal representing the wave of a first speech sound, a differential signal representing a difference between the wave of a second speech sound to be restored and the wave of the above described first speech sound, and pitch data showing the time length of a section equivalent to the unit pitch of the above described second speech sound;

obtaining sub-band information identified by the identification code obtained by the above described input means, of the above described sub-band information, and restoring the first pitch wave signal based on the obtained sub-band information;

creating a second pitch wave signal representing the sum of the wave of the restored first pitch wave signal and the wave represented by the above described differential signal; and creating a speech signal representing the above described second speech sound based on the above described pitch data and the above described second pitch wave data.

In addition, an alternative of the speech signal expansion method according to the second invention comprises the steps of:

obtaining an identification code for specifying sub-band information showing variation with time in the fundamental frequency component and harmonic wave component of a first pitch wave signal created by making substantially identical the time lengths of sections each equivalent to the unit pitch of a speech signal representing the wave of a first speech sound, a differential signal representing a difference in the fundamental frequency component and harmonic wave component between the wave of a second speech sound to be restored and the above described first speech sound, and pitch data showing the time length of a section equivalent to the unit pitch of the above described second speech sound;

obtaining sub-band information identified by the identification code obtained by the above described input means, of the above described sub-band information, and identifying the fundamental frequency component and the harmonic wave component of the above described second speech sound based on the obtained sub-band information and the above described differential signal; and creating a speech signal representing the above described second speech sound based on the above described pitch data and the identified fundamental frequency component and harmonic wave component of the above described second speech sound.

Third Invention

For achieving the object of the third invention, the speech synthesizing apparatus according to the first aspect of the third invention is comprised of:

storage means for storing rhythm information representing the rhythm of a sample of unit speech sound, pitch information representing the pitch of the sample, and spectrum information showing variation with time in the fundamental frequency component and harmonic wave component of a pitch wave signal created by making substantially identical the time lengths of sections each equivalent to the unit pitch of a speech signal representing the wave of the sample with such information brought into correspondence with the sample;

prediction means for inputting text information representing a text, and creating prediction information representing the result of predicting the pitch and spectrum of a unit speech sound constituting the text based on the text information;

retrieval means for identifying a sample having a pitch and spectrum having the highest correlation with the pitch and spectrum of the unit speech sound constituting the above described text based on the above described pitch information, spectrum information and prediction information; and signal synthesizing means for creating a synthesized speech signal representing a speech sound in which the speech sound has a rhythm represented by the rhythm information brought into correspondence with the sample identified by the above described retrieval means, the variation with time in the fundamental frequency component and harmonic wave component is represented by the spectrum information brought into correspondence with the sample identified by the above described retrieval means, and the time length of the section equivalent to the unit pitch is a time length represented by the pitch information brought into correspondence with the sample identified by the above described retrieval means.

The above described spectrum information may be constituted by data representing the result of nonlinearly quantizing a value showing variation with time in the fundamental frequency component and harmonic wave component of the pitch wave signal.

In addition, the speech dictionary creating apparatus according to the second aspect of this invention comprises:

pitch wave signal creating means for obtaining a speech signal representing the wave of a unit speech sound, and making substantially identical the time lengths of sections each equivalent to the unit pitch of the speech signal, thereby processing the speech signal into a pitch wave signal;

pitch information creating means for creating and outputting pitch information representing the original time length of the above described section;

spectrum information extracting means for creating and outputting spectrum information showing variation with time in the fundamental frequency component and harmonic wave component of the above described speech signal based on the pitch wave signal; and rhythm information creating means for obtaining phonetic data representing phonograms representing the pronunciation of the unit speech sound, determining the rhythm of the pronunciation represented by the phonetic data, and creating and outputting rhythm information representing the determined rhythm.

The above described spectrum information extracting means may comprise:

a variable filter having the frequency characteristics varied in accordance with control to filter the above described speech signal, thereby extracting a fundamental frequency component of the speech signal;

filter characteristic determining means for identifying the fundamental frequency of the above described unit speech sound based on the fundamental frequency component extracted by the above described variable filter, and controlling the above described variable filter so as to obtain frequency characteristics such that components other than those existing near the identified fundamental frequency are cut off;

pitch extracting means for dividing the above described speech signal into sections each constituted by a speech signal equivalent to a unit pitch based on the value of the fundamental frequency component of the speech signal; and a pitch length fixing unit creating a pitch wave signal with the time length in the each section being substantially identical by sampling the above described speech signal in the each above described section with the substantially the same number of specimens.

The above described filter characteristic determining means may comprise cross detecting means for identifying a period in which the fundamental frequency component extracted by the above described variable filter reaches a predetermined value, and identifying the above described fundamental frequency based on the identified period.

The above described filter characteristic determining means may comprise:

average pitch detecting means for detecting the time length of the pitch of the speech sound represented by the speech signal based on the speech signal before being filtered; and determination means for determining whether or not there is a difference by a predetermined amount or larger between the period identified by the above described cross detecting means and the time length of the pitch identified by the above described average pitch detecting means, and controlling the above described variable filter so as to obtain frequency characteristics such that components other than those existing near the fundamental frequency identified by the above described cross detecting means are cut off if it is determined that there is no such a difference, and controlling the above described variable filter so as to obtain frequency characteristics such that components other than those existing near the fundamental frequency identified from the time length of the pitch identified by the above described average pitch detecting means are cut off if it is determined that there is such a difference.

The above described average pitch detecting means may comprise:

cepstrum analyzing means for determining a frequency at which the cepstrum of a speech signal before being filtered by the above described variable filter has a maximum value;

self correlation analyzing means for determining a frequency at which the periodgram of the self correlation function of the speech signal before being filtered by the above described variable filter has a maximum value; and average calculating means for determining the average of pitches of the speech sound represented by the speech signal based on the frequencies determined by the above described cepstrum analyzing means and the above described self correlation analyzing means, and identifying the determined average as the time length of the pitch of the unit speech sound.

The above described spectrum information extracting means may create data representing the result of linearly quantizing the value showing variation with time in the fundamental frequency component and harmonic wave component of the above described speech signal and output the data as the above described spectrum information.

In addition, the speech synthesis method according to the third aspect of this invention comprises the steps of:

storing rhythm information representing the rhythm of a sample of unit speech sound, pitch information representing the pitch of the sample, and spectrum information showing variation with time in the fundamental frequency component and harmonic wave component of a pitch wave signal created by making substantially identical the time lengths of sections each equivalent to the unit pitch of a speech signal representing the wave of the sample with such information brought into correspondence with the sample;

inputting text information representing a text, and creating prediction information representing the result of predicting the pitch and spectrum of a unit speech sound constituting the text based on the text information;

identifying a sample having a pitch and spectrum having the highest correlation with the pitch and spectrum of the unit speech sound constituting the above described text based on the above described pitch information, spectrum information and prediction information; and creating a synthesized speech signal representing a speech sound in which the speech sound has a rhythm represented by the rhythm information brought into correspondence with the identified sample, the variation with time in the fundamental frequency component and harmonic wave component is represented by the spectrum information brought into correspondence with the sample identified by the above described retrieval means, and the time length of the section equivalent to the unit pitch is a time length represented by the pitch information brought into correspondence with the sample identified by the above described retrieval means.

In addition, the speech dictionary creation method according to the fourth aspect of this invention comprises steps of:

obtaining a speech signal representing the wave of a unit speech sound, and making substantially identical the time lengths of sections each equivalent to the unit pitch of the speech signal, thereby processing the speech signal into a pitch wave signal;

creating and outputting pitch information representing the original time length of the above described section;

creating and outputting spectrum information showing variation with time in the fundamental frequency component and harmonic wave component of the above described speech signal based on the pitch wave signal; and obtaining phonetic data representing phonograms representing the pronunciation of the unit speech sound, determining the rhythm of the pronunciation represented by the phonetic data, and creating and outputting rhythm information representing the determined rhythm.

MODE FOR CARRYING OUT THE INVENTION

Embodiments of the present invention (first, second and third inventions) will be described below with reference to the drawings.

First Invention

Figure 1:
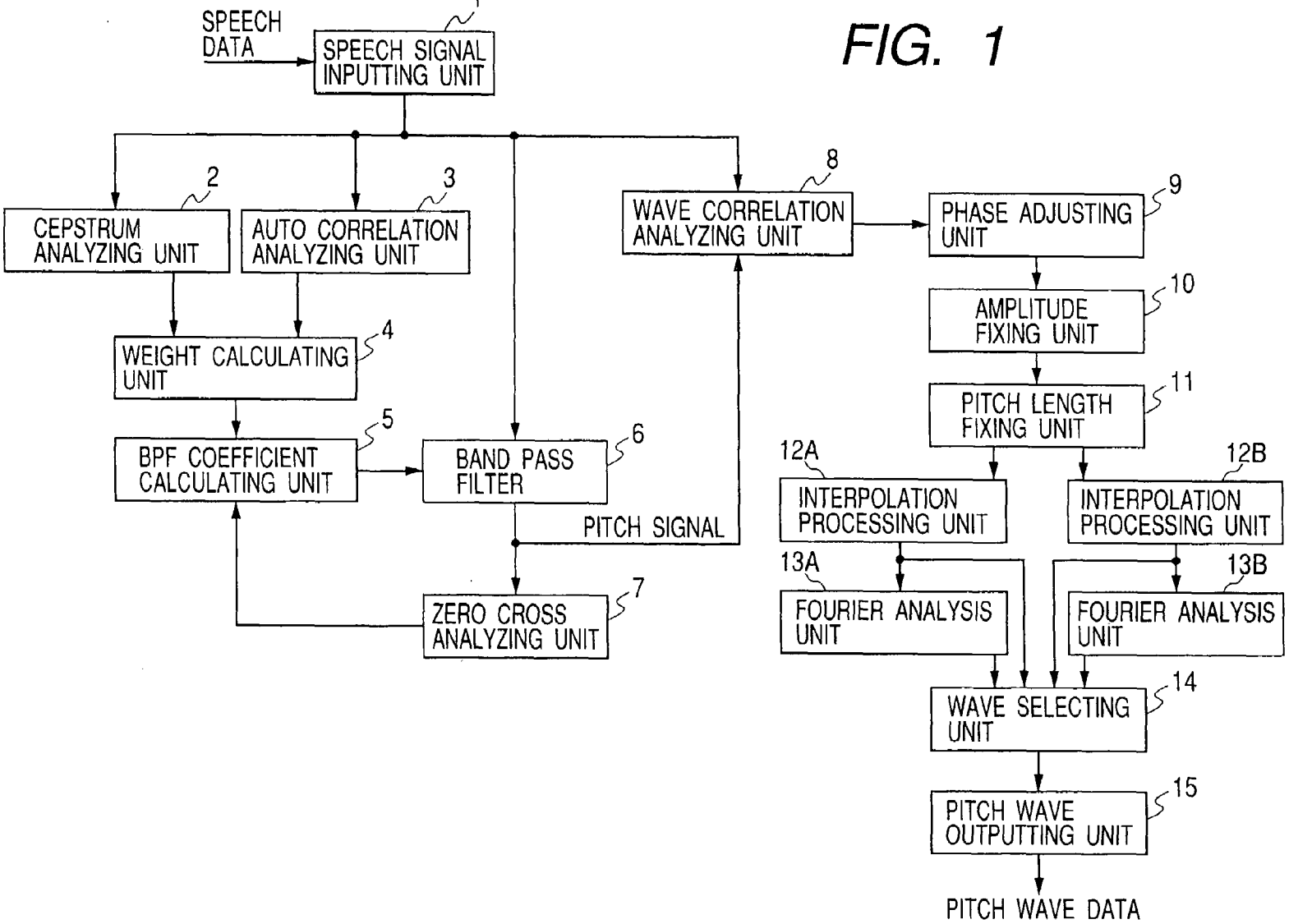
FIG. 1 shows a configuration of a pitch wave extracting system according to the embodiment of this invention.

FIG. 1 shows a configuration of a pitch wave extracting system according to the embodiment of the first invention. As shown in this figure, this pitch wave extracting system is comprised of a speech sound inputting unit 1, a cepstrum analyzing unit 2, a self correlation analyzing unit 3, a weight calculating unit 4, a band pass filter (BPF) coefficient calculating unit 5, a hand pass filter (BPF) 6, a zero cross analyzing unit 7, a wave correlation analyzing unit 8, a phase adjusting unit 9, an amplitude fixing unit 10, a pitch length fixing unit 11, interpolation processing units 12A and 12B, Fourier transformation units 13A and 13B, a wave selecting unit 14 and a pitch wave outputting unit 15.

The speech sound inputting unit 1 is constituted by, for example, a recording medium driver (flexible disk drive, MO drive, etc.) for reading data recorded in a recording medium (e.g. flexible disk and MO (Magneto Optical disk)) and the like.

The speech sound inputting unit 1 inputs speech data representing the wave of a speech sound to supply the speech data to the cepstrum analyzing unit 2, the self correlation analyzing unit 3, the BPF 6, the wave correlation analyzing unit 8 and the amplitude fixing unit 10.

Furthermore, speech data has a format of a PCM (Pulse Code Modulation)-modulated digital signal, and represents a speech sound sampled in a fixed period sufficiently shorter than the pitch of the speech sound.

The cepstrum analyzing unit 2, the self correlation analyzing unit 3, the weight calculating unit 4, the BPF coefficient calculating unit 5, the BPF 6, the zero cross analyzing unit 7, the wave correlation analyzing unit 8, the phase adjusting unit 9, the amplitude fixing unit 10, the pitch length fixing unit 11, the interpolation processing unit 12A, the interpolation processing unit 12B, the Fourier transformation unit 13A, the Fourier transformation unit 13B, the wave selecting unit 14 and the pitch wave outputting unit 15 are each constituted by a DSP (Digital Signal Processor), a CPU (Central Processing Unit) and the like.

Furthermore, the same DSP and CPU may perform part or all of functions of the cepstrum analyzing unit 2, the self correlation analyzing unit 3, the weight calculating unit 4, the BPF coefficient calculating unit 5, the BPF 6, the zero cross analyzing unit 7, the wave correlation analyzing unit 8, the phase adjusting unit 9, the amplitude fixing unit 10, the pitch length fixing unit 11, the interpolation processing unit 12A, the interpolation processing unit 12B, the Fourier transformation unit 13A, the Fourier transformation unit 13B, the wave selecting unit 14 and the pitch wave outputting unit 15.

The cepstrum analyzing unit 2 subjects speech data supplied from the speech sound inputting unit 1 to cepstrum analysis to identify the fundamental frequency of the speech sound represented by this speech data, and creates data showing the identified fundamental frequency and supplies the data showing the fundamental frequency to the weight calculating unit 4. Here, the cepstrum has been obtained by determining the logarithm of a spectrum as a function of a frequency and subjecting it to inverse Fourier transformation.

Specifically, when speech data is inputted from the speech sound inputting unit 1, the cepstrum analyzing unit 2 first determines the spectrum of this speech data, and converts the spectrum into a value substantially equal to the logarithm of the spectrum (base of the logarithm is not limited, and for example, a common logarithm may be used).

Then the cepstrum analyzing unit 2 determines the cepstrum by the method of fast inverse Fourier transformation (or any other method for creating data representing the result of subjecting a discrete variable to inverse Fourier transformation).

The minimum value of frequencies giving the maximum value of this cepstrum is identified as the fundamental frequency, and data showing the identified fundamental frequency is created and supplied to the weight calculating unit 4.

When speech data is supplied to the self correlation analyzing unit 3 from the speech sound inputting unit 1, the self correlation analyzing unit 3 identifies the fundamental frequency of the speech sound represented by this speech data based on the self correlation function of the wave of the speech data, and creates data showing the identified fundamental frequency and supplies the data to the weight calculating unit 4.

Specifically, when speech data is supplied to the self correlation analyzing unit 3 from the speech sound inputting unit 1, the self correlation analyzing unit 3 identifies a self correlation function r(1) represented by the right-hand side of formula 1:

$$r(1) = \frac{1}{N} \sum_{t=0}^{N-1-1} \{x(t+1) \cdot x(t)\} \qquad \text{[Formula 1]}$$

wherein N is the total number of samples of speech data, and $x(\alpha)$ is the value of the $\alpha$th sample from the head of speech data.

Then, the self correlation analyzing unit 3 identifies as the fundamental frequencies the minimum value of frequencies giving the maximum value of the function (periodgram) obtained as a result of subjecting the self correlation function r(1) to Fourier transformation and also exceeding a predetermined lower limit, and creates data showing the identified fundamental frequency and supplies the data to the weight calculating unit 4.

When the weight calculating unit 4 is supplied with total two data showing the fundamental frequencies, one from the cepstrum analyzing unit 2 and the other from the self correlation analyzing unit 3, the weight calculating unit 4 determines the average of absolute values of inverses of fundamental frequencies shown by the two data. Then, the weight calculating unit 4 creates data showing the determined value (i.e. average pitch length), and supplies the data to the BPF coefficient calculating unit 5.

When the BPF coefficient calculating unit 5 is supplied with data showing the average pitch length from the weight calculating unit 4, and is supplied with a zero cross signal described later from the zero cross analyzing unit 7, the BPF coefficient calculating unit 5 determines whether or not there is a difference by a predetermined amount or larger between the average pitch length and the period of the pitch signal and zero cross based on the supplied data and the zero cross signal. Then, if it is determined that there is not such a difference, the BPF coefficient calculating unit 5 controls the frequency characteristics of the BPF 6 so that the inverse of the period of zero cross equals the central frequency (central frequency of the pass band of the BPF 6). On the other hand, if it is determined that there is such a difference by a predetermined amount or larger, the BPF coefficient calculating unit 5 controls the frequency characteristics of the BPF 6 so that the inverse of the average pitch length equals the central frequency.

The BPF 6 performs the function of a FIR (Finite Impulse Response) type filter with a variable central frequency.

Specifically, the BPF 6 sets its own central frequency to a value appropriate to the control of the BPF coefficient calculating unit 5. Then, the BPF 6 filters speech data supplied from the speech sound inputting unit 1, and supplies the filtered speech data (pitch signal) to the zero cross analyzing unit 7 and the wave correlation analyzing unit 8. The pitch signal is constituted by digital data of which sampling intervals are substantially identical to those of speech data.

Furthermore, it is desirable that the bandwidth of the BPF 6 is such that the upper limit of the pass band of the BPF 6 is no more than twice as high as the fundamental frequency of speech sound represented by speech data all the time.

The zero cross analyzing unit 7 identifies a time at which the instantaneous value of the pitch signal supplied from the BPF 6 reaches 0 (time at which zero cross occurs), and supplies a signal representing the identified time (zero cross signal) to the wave correlation analyzing unit 8.

However, the zero cross analyzing unit 7 may identify a time at which the instantaneous value of the pitch signal reaches a predetermined value other than O, and supply a signal representing the identified time to the wave correlation analyzing unit 8 instead of the zero cross signal.

The wave correlation analyzing unit 8 is supplied with speech data from the speech sound inputting unit 1 and the pitch signal from the band pass filter 6 to operate so that speech data is divided in synchronization with the time at which the boundary of a unit period (e.g. one period) of the pitch signal is reached. For each divided section, a correlation between speech data in the section of which phase is changed in a variety of ways and the pitch signal in the section is determined, and a phase of the speech data providing the highest correlation is identified as the phase of speech data of speech data in the section.

Specifically, the wave correlation analyzing unit 8 determines, for example, the value of cor represented by the right-hand side of formula (2) for each section each time when the value of $\psi$ representing a phase ($\psi$ is an integer number equal to or greater than 0) is changed in a variety of ways. Then, the wave correlation analyzing unit 8 determines the value of $\psi$ ($\Psi$) providing the maximum value of cor, creates data representing the value $\Psi$, and supplies the data to the phase adjusting unit 9 as phase data representing the phase of speech data in the section.

$$cor = \sum_{i=1}^{n} \{f(i-\phi) \cdot g(i)\} \qquad \text{[Formula 2]}$$

wherein n is the total number of samples in the section, $f(\beta)$ is the value of the $\beta$th sample from the head of speech data in the section, and g ($\gamma$) is the value of the $\gamma$th sample from the head of the pitch signal in the section).

Furthermore, it is desirable that the temporal length of the section is equivalent to about one pitch. As the length of the section increases, the number of samples in the section is increased and thus the data amount of the pitch wave signal is increased, or the number of intervals at which sampling is performed is increased, so that a speech sound represented by the pitch wave signal becomes inaccurate.

When the phase adjusting unit 9 is supplied with speech data from the speech sound inputting unit 1, and is supplied with data showing the phase $\Psi$ of each section of the speech data from the wave correlation analyzing unit 8, the phase adjusting unit 9 shifts the phase of the speech data of each section so that the phase of the speech data equals the phase $\Psi$ of the section. Then, the phase-shifted speech data is supplied to the amplitude fixing unit 10.

When the amplitude fixing unit 10 is supplied with the phase-shifted speech data from the phase adjusting unit 9, the amplitude fixing unit 10 multiplies this speech data by a proportionality factor for each section to change its amplitude, and supplies the speech data with the changed amplitude to pitch length fixing unit 11. In addition, proportionality factor data showing correspondence between sections and proportionality factor values applied thereto is created and supplied to the pitch wave outputting unit 15.

The proportionality factor by which speech data is multiplied is determined so that the effective value of the amplitude of each section of speech data is a common fixed value. That is, provided that this fixed value equals J, the amplitude fixing unit 10 divides the fixed value J by the effective value K of the amplitude of the section of speech data to obtain a value (J/K). This value (J/K) is the proportionality factor to be applied to the section.

When the pitch length fixing unit 11 is supplied with speech data with the changed amplitude from the amplitude fixing unit 10, the pitch length fixing unit 11 samples again (resamples) each section of this speech data, and supplies the resampled speech data to interpolation processing units 12A and 12B.

In addition, the pitch length fixing unit 11 creates sample number data showing the number of original samples of each section, and supplies the data to the pitch wave outputting unit 15.

Furthermore, the pitch length fixing unit 11 performs resampling in such a manner as to sample data at regular intervals in the same section so that the number of samples of each section of speech data is almost the same.

When the interpolation processing unit 12A is supplied with the resampled speech data from the pitch length fixing unit 11, the interpolation processing unit 12A creates data representing values for carrying out interpolation between samples of this speech data by the method of Lagrange's interpolation, and supplies this data (data of Lagrange's interpolation) to the Fourier transformation unit 13A and the wave selecting unit 14 together with the resampled speech data.

The resampled speech data and the data of Lagrange's interpolation constitute speech data after Lagrange's interpolation.

The interpolation processing unit 12B creates data (data of Gregory/Newton's interpolation) representing values for carrying out interpolation between samples of the speech data supplied from the pitch length fixing unit 11 by the method of Gregory/Newton's interpolation, and supplies the data to the Fourier transformation unit 13B and the wave selecting unit 14 together with the sampled speech data. The resampled speech data and the data of Gregory/Newton's interpolation constitute speech data after Gregory/Newton's interpolation.

In both Lagrange's interpolation and Gregory/Newton's interpolation, the harmonic wave component of the wave is reduced to relatively a low level. However, since these two methods use different functions for interpolation between two points, the amount of harmonic wave components is different between the two methods depending on the values of samples to be interpolated.

When the Fourier transformation unit 13A (or 13B) is supplied with speech data after Lagrange's interpolation (or speech data after Gregory/Newton's interpolation) from the interpolation processing unit 12A (or 12B), the Fourier transformation unit 13A (or 13B) determines the spectrum of this speech data by the method of fast Fourier transformation (or any other method for creating data representing the result of subjecting a discrete variable to Fourier transformation). Then, data representing the determined spectrum is supplied to the wave selecting unit 14.

When the wave selecting unit 14 is supplied with speech data after interpolation representing the same sound from the interpolation processing units 12A and 12B, and is supplied with the spectrum of this speech data from the Fourier transformation units 13A and 13B, the wave selecting unit 14 determines which of the speech data after Lagrange's interpolation and the speech data after Gregory/Newton's interpolation has smaller harmonic wave deformation based on the supplied spectrum. One of the speech data after Lagrange's interpolation and the speech data after Gregory/Newton's interpolation determined to have smaller harmonic wave deformation is supplied to the pitch wave outputting unit 15 as a pitch wave signal.

It can be considered that when the pitch length fixing unit 11 resamples each section of pitch wave data, the wave of each section is deformed. However, since the wave selecting unit 14 selects a pitch wave signal having the smallest number of harmonic wave components, of pitch wave signals subjected to interpolation by a plurality of methods, the number of harmonic wave components included in pitch wave data finally outputted by the pitch wave outputting unit 15 is reduced to a low level.

Furthermore, for example, the wave selecting unit 14 may determine the effective value of a component of which frequency is two times or more higher than the fundamental frequency for each of the two spectra supplied from the Fourier transformation units 13A and 13B, and identify the spectrum of which the determined effective value is smaller as the spectrum of speech data having smaller harmonic wave deformation, thereby making the determination.

When the pitch wave outputting unit 15 is supplied with proportionality factor data from the amplitude fixing unit 10, is supplied with sample number data from the pitch length fixing unit 11, and is supplied with pitch wave data from the wave selecting unit 14, the pitch wave outputting unit 15 outputs the three data with the data brought into correspondence with one another.

For the pitch wave signal outputted from the pitch wave outputting unit 15, the length and the amplitude of the section of a unit pitch are normalized, and thus influence of fluctuation of the pitch is eliminated. Therefore, a sharp peak showing pitch frequency is obtained from the spectrum of the pitch wave signal, the pitch frequency can be extracted with high accuracy from the pitch wave signal.

Figure 2:
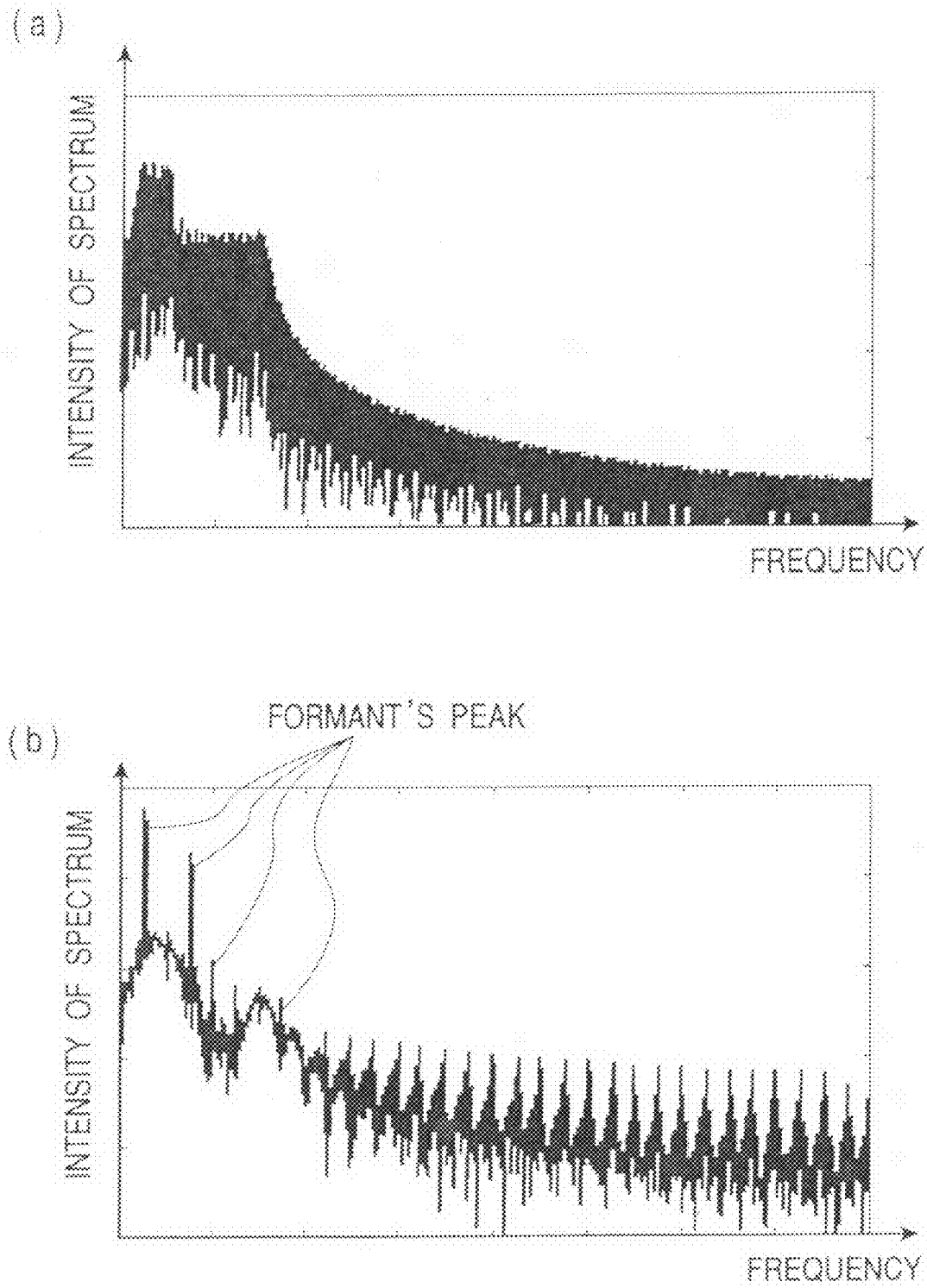
FIG. 2(*a*) shows an example of a spectrum of a speech sound obtained by the conventional method, and FIG. 2(*b*) shows an example of a spectrum of a pitch wave signal obtained by a pitch wave extracting system according to the embodiment of this invention.

Specifically, the spectrum of speech data with fluctuation of the pitch not eliminated shows a broad distribution with no clear peak exhibited due to fluctuation of the pitch as shown in FIG. 2(*a*), for example.

On the other hand, when pitch wave data is created from speech data having the spectrum shown in FIG. 2(*a*) using this pitch wave extracting system, a spectrum shown in FIG. 2(*b*), for example, is obtained as the spectrum of this pitch wave data. As shown in this figure, the spectrum of this pitch wave data has a clear peak of pitch frequency.

In addition, since the influence of fluctuation of the pitch is eliminated from the pitch wave signal outputted from the pitch wave outputting unit 15, the formant component is extracted with high reproducibility from the pitch wave signal. That is, the substantially same formant component is easily extracted from pitch wave signals representing speech sounds of a same speaker. Therefore, when the speech sound is to be compressed by a method using a codebook, for example, data of formant of the speaker obtained on a plurality of occasions can easily be used in conjunction.

In addition, the original time length of each section of the pitch wave signal can be identified using sample number data, and the original amplitude of each section of the pitch wave signal can be identified using proportionality factor data. Therefore, by restoring the length and the amplitude of each section of the pitch wave signal to the length and the amplitude in original speech data, the original speech data can easily be restored.

Furthermore, the configuration of this pitch wave extracting system is not limited to that described above.

For example, the speech sound inputting unit 1 may obtain speech data from the outside via a communication line such as a telephone line, a dedicated line and a satellite line. In this case, the speech sound inputting unit 1 is simply provided with a communication controlling unit constituted by, for example, a modem and a DSU (Data Service Unit).

In addition, the speech sound inputting unit 1 may comprise a sound collecting apparatus constituted by a microphone, an AF (Audio Frequency) amplifier, a sampler, an A/D (Analog-to-Digital) converter, a PCM encoder and the like. The sound collecting apparatus amplifies a speech signal representing a speech sound collected by its own microphone, and samples and A/D-converts the speech signal, followed by subjecting the sampled speech signal to PCM modulation, thereby obtaining speech data. Furthermore, speech data obtained by the speech sound inputting unit 1 is not necessarily a PCM signal.

In addition, the pitch wave outputting unit 15 may supply proportionality factor data, sample number data and pitch wave data to the outside via the communication line. In this case, the pitch wave outputting unit 15 is simply provided with a communication controlling unit constituted by a modem, a DSU and the like.

In addition, the pitch wave outputting unit 15 may write proportionality factor data, sample number data and pitch wave data in an external recording medium and an external storage apparatus constituted by a hard disk apparatus or the like. In this case, the pitch wave outputting unit 15 is simply provided with a recording medium driver and a control circuit such as a hard disk controller.

In addition, the method of interpolation performed by the interpolation processing units 12A and 12B is not limited to Lagrange's interpolation and Gregory/Newton's interpolation, and any other method may be used. In addition, this pitch wave extracting system may perform interpolation of speech data by three or more types of methods, and select speech data having smallest harmonic wave deformation as pitch wave data.

In addition, in this pitch wave extracting system, one interpolation processing unit may perform interpolation of speech data by one type of method, and the speech data may directly be dealt with as pitch wave data. In this case, this pitch wave extracting system needs to have neither the Fourier transformation unit 13A or 13B nor the wave selecting unit 14.

In addition, this pitch wave extracting system does not necessarily need to make uniformalize the effective value of the amplitude of speech data. Therefore, the amplitude fixing unit 10 is not an essential element, and the phase adjusting unit 9 may supply phase-shifted speech data directly to the pitch length fixing unit 11.

In addition, this pitch wave extracting system does not need to have the cepstrum analyzing unit 2 (or self correlation analyzing unit 3) and in this case, the weight calculating unit 4 may deal with directly as an average pitch length the inverse of the fundamental frequency determined by the cepstrum analyzing unit 2 (or self correlation analyzing unit 3).

In addition, the zero cross analyzing unit 7 may directly supply to the BPF coefficient calculating unit 5 as a zero cross signal the pitch signal supplied from the BPF 6.

The embodiment of this invention has been described above, but the pitch wave signal creating apparatus according to this invention can be achieved using a usual computer system instead of a dedicated system.

For example, a programs for executing the operations of the above described speech sound inputting unit 1, cepstrum analyzing unit 2, self correlation analyzing unit 3, weight calculating unit 4, BPF coefficient calculating unit 5, BPF 6, zero cross analyzing unit 7, wave correlation analyzing unit 8, phase adjusting unit 9, amplitude fixing unit 10, pitch length fixing unit 11, interpolation processing unit 12A, interpolation processing unit 12B, Fourier transformation unit 13A, Fourier transformation unit 13B, wave selecting unit 14 and pitch wave outputting unit 15 is installed in a computer from a medium (CD-ROM, MO, flexible disk, etc.) storing the program, whereby a pitch wave extracting system performing the above described processing can be built.

In addition, for example, this program may be published on a bulletin board system (BBS) of a communication line and delivered via the communication line, or this program may be restored in such a manner that a carrier wave is modulated by a signal representing this program, the modulated wave obtained is transmitted, and the apparatus receiving this modulated wave demodulates the modulated wave.

Then, this program is started, and is executed in the same way as other application programs under the control by the OS, whereby the above described processing can be performed.

Furthermore, if the OS performs part of processing, or the OS constitutes one element of this invention, a program from which such part is removed may be stored in the recording medium. Also in this case, in this invention, a program for performing each function or step carried out by the computer is stored in the recording medium.

Second Invention

The embodiment of the second invention will be described using a speech signal compressor and a speech signal expander as an example.

Speech Signal Compressor

Figure 3:
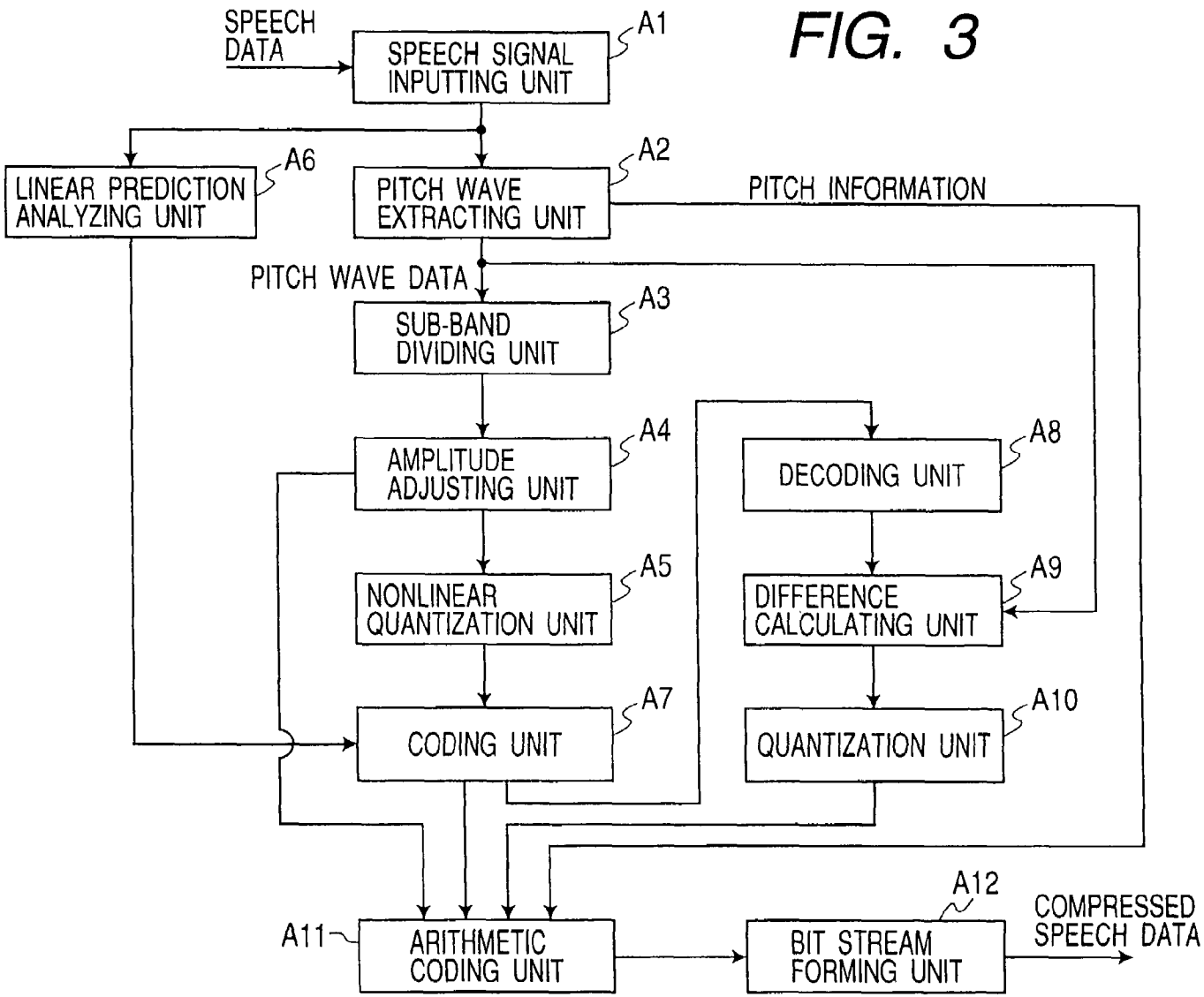
FIG. 3 is a block diagram showing a configuration of a speech signal compressor according to the embodiment of this invention.

FIG. 3 shows a configuration of the speech signal compressor according to the embodiment of this invention. As shown in this figure, this speech signal compressor is comprised of a speech sound inputting unit A1, a pitch wave extracting unit A2, a sub-band dividing unit A3, an amplitude adjusting unit A4, a nonlinear quantization unit A5, a linear prediction analysis unit A6, a coding unit A7, a decoding unit A8, a difference calculating unit A9, a quantization unit A10, an arithmetic coding unit A11 and a bit stream forming unit A12.

The speech sound inputting unit A1 is constituted by, for example, a recording medium driver (flexible disk drive, MO drive, etc.) for reading data recorded in a recording medium (e.g. flexible disk and MO (Magneto Optical disk).

The speech sound inputting unit A1 obtains speech data representing the wave of the speech sound by reading the speech data from the recording medium in which this speech data is stored and so on, and supplies the speech data to the pitch wave extracting unit A2 and the linear prediction analysis unit A6.

The pitch wave extracting unit A2, the sub-band dividing unit A3, the amplitude adjusting unit A4, the nonlinear quantization unit A5, the linear prediction analysis unit A6, the coding unit A7, the decoding unit A8, the difference calculating unit A9, the quantization unit A10 and the arithmetic coding unit A11 are each constituted by a processor such as a DSP (Digital Signal Processor) and a CPU (Central Processing Unit).

Furthermore, part or all of functions of the pitch wave extracting unit A2, the sub-band dividing unit A3, the amplitude adjusting unit A4, the nonlinear quantization unit A5, the linear prediction analysis unit A6, the coding unit A7, the decoding unit A8, the difference calculating unit A9, the quantization unit A10 and the arithmetic coding unit A11 may performed by a single processor.

The pitch wave extracting unit A2 divides speech data supplied from the speech sound inputting unit A1 into sections each equivalent to a unit pitch (e.g. one pitch) of the speech sound represented by this speech data. Then, the divided section is phase-shifted and resampled to make substantially identical the time lengths and phases of the sections.

Then, the speech data (pitch wave data) with the time lengths and phases of the sections made identical to one another is supplied to the sub-band dividing unit A3 and the difference calculating unit A9.

In addition, the pitch wave extracting unit A2 creates pitch information showing the original number of samples in each section of this speech data, and supplies the pitch information to the arithmetic coding unit A11.

For example, the pitch wave extracting unit A2 is comprised of the cepstrum analyzing unit 2, the self correlation analyzing unit 3, the weight calculating unit 4, the BPF (band pass filter) coefficient calculating unit 5, the band pass filter 6, the zero cross analyzing unit 7, the wave correlation analyzing unit 8, the phase adjusting unit 9 and the amplitude fixing unit 10 in terms of functionality as shown in FIG. 2.

The operation and function of the pitch wave extracting unit is same as those described in the first invention.

When the pitch length fixing unit 11 is supplied with the phase-shifted speech data from the phase adjusting unit 9, the pitch length fixing unit 11 resamples the sections of the supplied speech data to make substantially identical the time lengths of the sections. Then, the speech data (bit wave data) with the time lengths of the sections made identical to one another is supplied to the sub-band dividing unit A3 and the difference calculating unit A9.

In addition, the pitch length fixing unit 11 creates pitch information showing the original number of samples in each section of this speech data (the number of samples in each section of this speech data at the time when the speech data is supplied from the speech sound inputting unit 1 to the pitch length fixing unit 11), and supplies the pitch information to the arithmetic coding unit A11. Provided that the interval at which the speech data obtained by the speech data inputting unit A1 is sampled is known, the pitch information functions as information showing the original time length of the section equivalent to the unit pitch of this speech data.

The sub-band dividing unit A3 subjects the pitch wave data supplied from the pitch wave extracting unit A2 to orthogonal transformation such as DCT (Discrete Cosine Transformation), thereby creates sub-band data. Then, the created sub-band data is supplied to the amplitude adjusting unit A4.

The sub-band data includes data showing variation with time in the intensity of the fundamental frequency component of a speech sound represented by the pitch wave signal and n data (n is a natural number) showing variation with time in the intensity of n fundamental frequency components of this speech sound. Thus, when there is no variation with time in the intensity of the fundamental frequency component (or harmonic wave component), the sub-band data represents the intensity of this fundamental frequency component (or harmonic wave component) in the form of direct current signal.

When the amplitude adjusting unit A4 is supplied with sub-band data from the sub-band dividing unit A3, the amplitude adjusting unit A4 multiplies by a proportionality factor the instantaneous values of the fundamental frequency component and the harmonic wave component represented by this sub-band data to change the amplitude, and supplies the sub-band data with the changed amplitude to the nonlinear quantization unit A5.

In addition, amplitude adjusting unit A4 creates proportionality factor data showing correspondence between sub-band data and frequency components (fundamental frequency component or harmonic wave component) thereof and proportionality factor values applied thereto, and supplies this proportionality factor data to the arithmetic coding unit A11.

The proportionality factor is determined so that the maximum value of the intensity of frequency components represented by the same sub-band data is a common fixed value, for example. That is, provided that this fixed value equals J, for example, the amplitude adjusting unit A4 divides the fixed value J by the maximum value K of the intensity of a specific frequency component to calculate a value (J/K). This value (J/K) is the proportionality factor by which the instantaneous value of this frequency component is multiplied.

When the nonlinear quantization unit A5 is supplied with the sub-band data with the changed amplitude from the amplitude adjusting unit A4, the nonlinear quantization unit A5 creates sub-band data equivalent to data obtained by quantizing a value obtained by subjecting the instantaneous value of each frequency component represented by this sub-band data to nonlinear compression (specifically, value obtained by substituting the instantaneous value into an upward convex function, for example), and supplies the created sub-band data (sub-band data after nonlinear quantization) to the coding unit A7.

Furthermore, the method of nonlinear compression may be any method in which specifically the linear quantization unit A5 is such that the instantaneous value of each frequency component after quantization is substantially equal to a value obtained by quantizing the logarithm of the original instantaneous value (however, the base of the logarithm is common for all frequency components (e.g. common logarithm)).

The linear prediction analysis unit A6 subjects speech data supplied from the speech sound inputting unit A1 to linear prediction analysis, thereby extracting an identifying parameter specific to a speaker of a speech sound represented by this speech data (e.g. envelope data representing the envelope of the spectrum of this speech sound or data representing the formant of this data). Then, the extracted parameter is supplied to the coding unit A7.

The coding unit A7 comprises a storage apparatus constituted by a hard disk apparatus or the like in addition to a processor.

The coding unit A7 stores a parameter specific to the speaker and identical in type to the identifying parameter extracted by the linear prediction analysis unit A6 (e.g. envelope data if the identifying parameter is envelope data) for each speaker. In addition, a phoneme dictionary representing phonemes constituting the speech sound of the speaker is stored with the phoneme dictionary brought into correspondence with the parameter of each speaker. Specifically, the phoneme dictionary stores sub-band data showing variation with time in the intensity of the fundamental frequency component and the harmonic wave component of the phoneme for each phoneme. Each sub-band data is assigned an identification code specific to the sub-band data.

When the coding unit A7 is supplied with sub-band data after nonlinear quantization from the nonlinear quantization unit A5, and is supplied with the identifying parameter from the linear prediction analysis unit A6, the coding unit A7 identifies a parameter that can be most approximated to the identifying parameter supplied from the linear prediction analysis unit A6, of parameters stored in the coding unit A7 itself, thereby selecting a phoneme dictionary brought into correspondence with this parameter.

If the identifying parameter and the parameter stored in the coding unit A7 are both constituted by envelope data, the coding unit A7 may identify, for example, a parameter representing an envelop having the largest coefficient of correlation with the envelope represented by the identifying parameter as a parameter that can be most approximated to the identifying parameter.

Then, the coding unit A7 identifies sub-band data representing a wave closest to that of the sub-band data supplied from the nonlinear quantization unit A5, of sub-band data included in the selected phoneme dictionary. Specifically, for example, the coding unit A7 carries out processing described below as (1) and (2). That is:

(1) first, coefficients of correlation between same frequency components are each determined between sub-band data supplied from the nonlinear quantization unit A5 and dub-band data of one phoneme included in the selected phoneme dictionary, and the average of the determined coefficients is calculated.

(2) the processing (1) is carried out for sub-band data of all phonemes included in the selected phoneme dictionary, and sub-band data for which the average of the coefficient of correlation is the largest is identified as sub-band data representing a wave closest to that of the sub-band data supplied from the nonlinear quantization unit A5.

Then, the coding unit A7 supplies an identification code assigned to the identified sub-band data to the arithmetic coding unit A11. The identified sub-band data is also supplied to the decoding unit A8.

The decoding unit A8 transforms the sub-band data supplied from the coding unit A7, and thereby restores pitch wave data with the intensity of each frequency component represented by this sub-band data. Then, the restored pitch wave data is supplied to the difference calculating unit A9.

The transformation applied to sub-band data by the decoding unit A8 is substantially in inverse relationship with the transformation applied to the wave of the phoneme to create this sub-band data. Specifically, if this sub-band data is data created by subjecting the phoneme to DCT, the decoding unit A8 may subject this sub-band data to IDCT (Inverse DCT).

The difference calculating unit A9 creates differential data representing a difference between the instantaneous value of pitch wave data supplied from the pitch wave extracting unit A2 and the instantaneous value of pitch wave data supplied from the difference calculating unit A9 and supplies the differential data to the quantization unit A10.

The quantization unit A10 comprises a storage apparatus such as a ROM (Read Only Memory) in addition to a processor.

The quantization unit A10 stores a parameter showing accuracy with which a differential signal is quantized (or compression ratio representing a ratio of the data amount of the differential signal after quantization to the data amount of the differential signal before quantization) according to the operation by the user or the like. When the quantization unit A10 is supplied with the differential signal from the difference calculating unit A9, the quantization unit A10 quantizes the instantaneous value of this differential signal with the accuracy shown by the parameter stored in the quantization unit A10 (or quantizes the value so as to obtain the compression ratio represented by this parameter), and supplies the quantized differential data to the arithmetic coding unit A11.

The arithmetic coding unit A11 converts into arithmetic codes the identification code supplied from the coding unit A7, the differential data supplied from the quantization unit A10, the pitch information supplied from the pitch wave extracting unit A2 and the proportionality factor data supplied from the amplitude adjusting unit A4, and supplies the arithmetic codes to the bit stream forming unit A12 with the arithmetic codes brought into correspondence with one another.

The bit stream forming unit A12 is comprised of, for example, a control circuit controlling serial communication with the outside in accordance with a specification such as RS232C, and a processor such as a CPU.

The bit stream forming unit A12 creates a bit stream representing the arithmetic codes brought into correspondence with one another and supplied from the arithmetic coding unit A11, and outputs the bit stream as compressed speech data.

The compressed speech data is created based on pitch wave data that is speech data in which the time length of the section equivalent to a unit pitch is normalized and the influence of fluctuation of the pitch is eliminated. Therefore, the compressed speech data accurately represents the variation with time in the intensities of frequency components (fundamental frequency component and harmonic wave component) of the speech sound.

In addition, the compressed speech data is constituted by differential data representing a difference between an identification code for identifying a speech sound for which data of the sample of the variation with time in intensities of frequency components is previously prepared and this speech sound.

Figure 4:
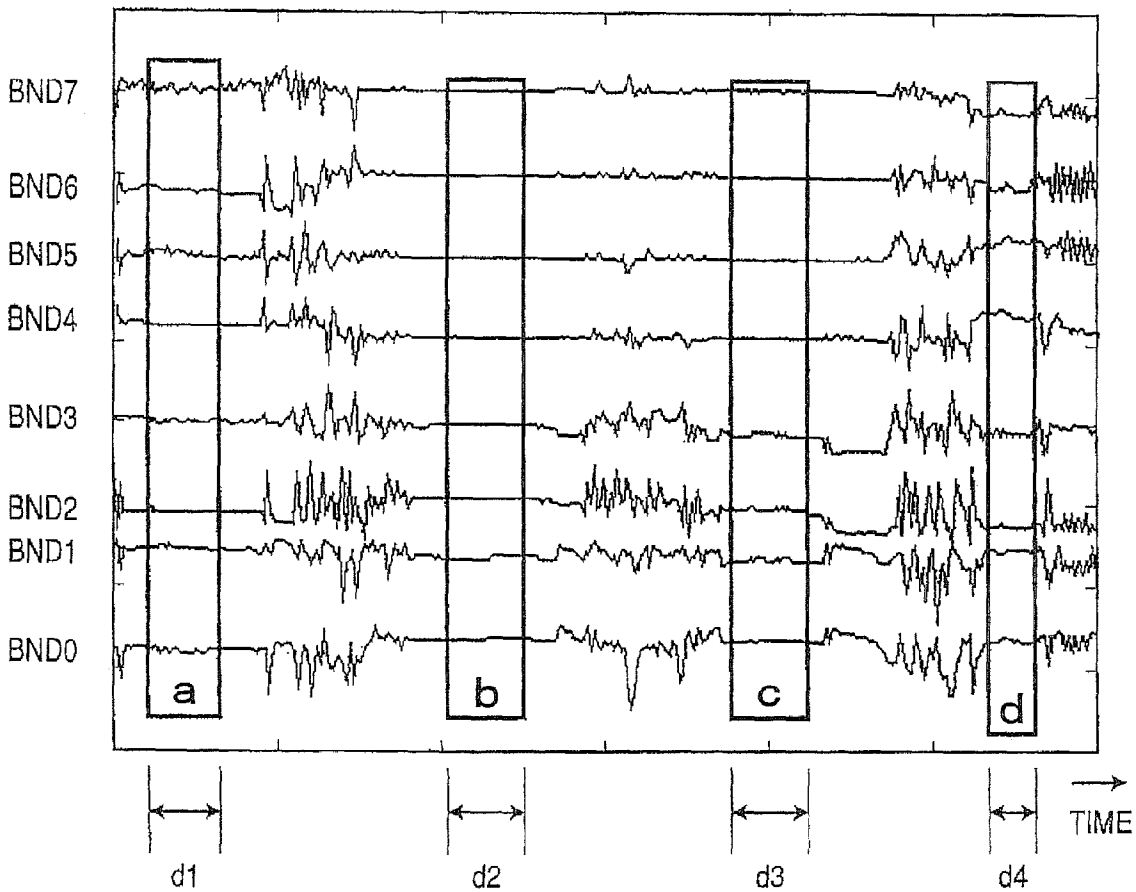
FIG. 4 is a graph showing an example of variation with time in the intensity of each frequency component of the speech sound.

On the other hand, as shown in FIG. 4 for example, the variation with time in the intensities of frequency components of a voiced sound actually generated by man is very small, and the difference in the intensity between speech sounds of the same speaker is also small. Therefore, sub-band data representing the speech sound of a speaker identical to the speaker whose speech sound is to be compressed is previously stored in the phoneme dictionary, and an identifying parameter specific to this speaker is brought into correspondence therewith, whereby the data amount of differential data is considerably reduced. Thus, the data amount of compressed speech data is also considerably reduced.

Furthermore, in FIG. 4, the graph shown as "BND0" shows the intensity of the fundamental frequency component of the speech sound, and the graph shown as "BNDk" (k is an integer number of from 1 to 7) shows the intensity of the (k+1) -order harmonic wave component of this speech sound. The section shown as "d1" is a section representing a vowel "a", the section shown as "d2" is a section representing a vowel "i", the section shown as "d3" is a section representing a vowel "u", and the section shown as "d4" is a section representing a vowel "e".

In addition, the original time length of each section of the pitch wave signal can be identified using pitch information, and the original amplitude of each frequency component can be identified using proportionality factor data. Therefore, by restoring the time length of each section and the amplitude of each frequency component of the pitch wave signal to the time length and the amplitude in the original speech data, the original speech data can easily be restored.

Furthermore, the configuration of this speech signal compressor is not limited to that described above.

For example, the speech sound inputting unit A1 may obtain speech data from the outside via a communication line such as a telephone line, a dedicated line and a satellite line. In this case, the speech sound inputting unit A1 is simply provided with a communication controlling unit constituted by, for example, a modem, a DSU (Data Service Unit) and the like.

In addition, the speech sound inputting unit A1 may comprise a sound collecting apparatus constituted by a microphone, an AF amplifier, a sampler, an A/D (Analog-to-Digital) converter, a PCM encoder and the like. The sound collecting apparatus amplifies a speech signal representing a speech sound collected by its own microphone, and samples and A/D-converts the speech signal, followed by subjecting the sampled speech signal to PCMmodulation, thereby obtaining speech data. Furthermore, speech data obtained by the speech sound inputting unit A1 is not necessarily a PCM signal.

In addition, the pitch wave extracting unit A2 does not necessarily comprise a cepstrum analyzing unit A21 (or self correlation analyzing unit A22) and in this case, a weight calculating unit A23 may deal with directly the inverse of the fundamental frequency determined by the cepstrum analyzing unit A21 (or self correlation analyzing unit A22) as an average pitch length.

In addition, a zero cross analyzing unit A26 may supply a pitch signal supplied from a band pass filter A25 directly to a BPF coefficient calculating unit A24 as a zero cross signal.

In addition, the bit stream forming unit A12 may output compressed speech data to the outside via the communication line or the like. In the case where data is outputted to the outside via the communication line, the bit stream forming unit A12 is simply provided with a communication controlling unit constituted by, for example, a modem, a DSU and the like.

In addition, the bit stream forming unit A12 may comprise a recording medium driver and in this case, the bit stream forming unit A12 may write data to be stored in the speech dictionary in the storage area of a recording medium set in this recording medium driver.

Furthermore, a single modem, DSU or recording medium driver may constitute the speech sound inputting unit A1 and the bit stream forming unit A12.

In addition, the difference calculating unit A9 may obtain sub-band data after nonlinear quantization created by the nonlinear quantization unit A5, and obtain sub-band data identified by the coding unit A7.

In this case, the difference calculating unit A9 may determine a difference between the instantaneous value of the intensity of each frequency component represented by sub-band data after nonlinear quantization created by the nonlinear quantization unit A5 and the instantaneous value of each frequency component represented by sub-band data identified by the coding unit A7 for each set of components having the same frequency, and create differential data representing the each determined difference and supplies the differential data to the quantization unit A10.

In addition, the coding unit A7 may comprise a storage unit for storing the newest sub-band data of sub-band data after nonlinear quantization supplied from the nonlinear quantization unit A5 in the past. In this case, each time sub-band data after nonlinear quantization is newly supplied to the coding unit A7, the coding unit A7 may determine whether or not the sub-band data has a certain level or greater of correlation with sub-band data after nonlinear quantization stored in the coding unit A7, and supply predetermined data showing that a wave identical to the immediately preceding wave follows in succession to the arithmetic coding unit A11 in place of the identification code and differential data if it is determined that the sub-band data has such a level of correlation. In this way, the data amount of compressed speech data is further reduced.

Furthermore, for example, the level of correlation between the newly supplied sub-band data and the sub-band data stored in the coding unit A7 may be determined in such a manner that coefficients of correlation between same frequency components are each determined between both the sub-band data, and the determination is made based on the magnitude of the average of the determined coefficients, for example.

Speech Signal Expander

The speech signal expander according to the embodiment of this invention will now be described.

Figure 5:
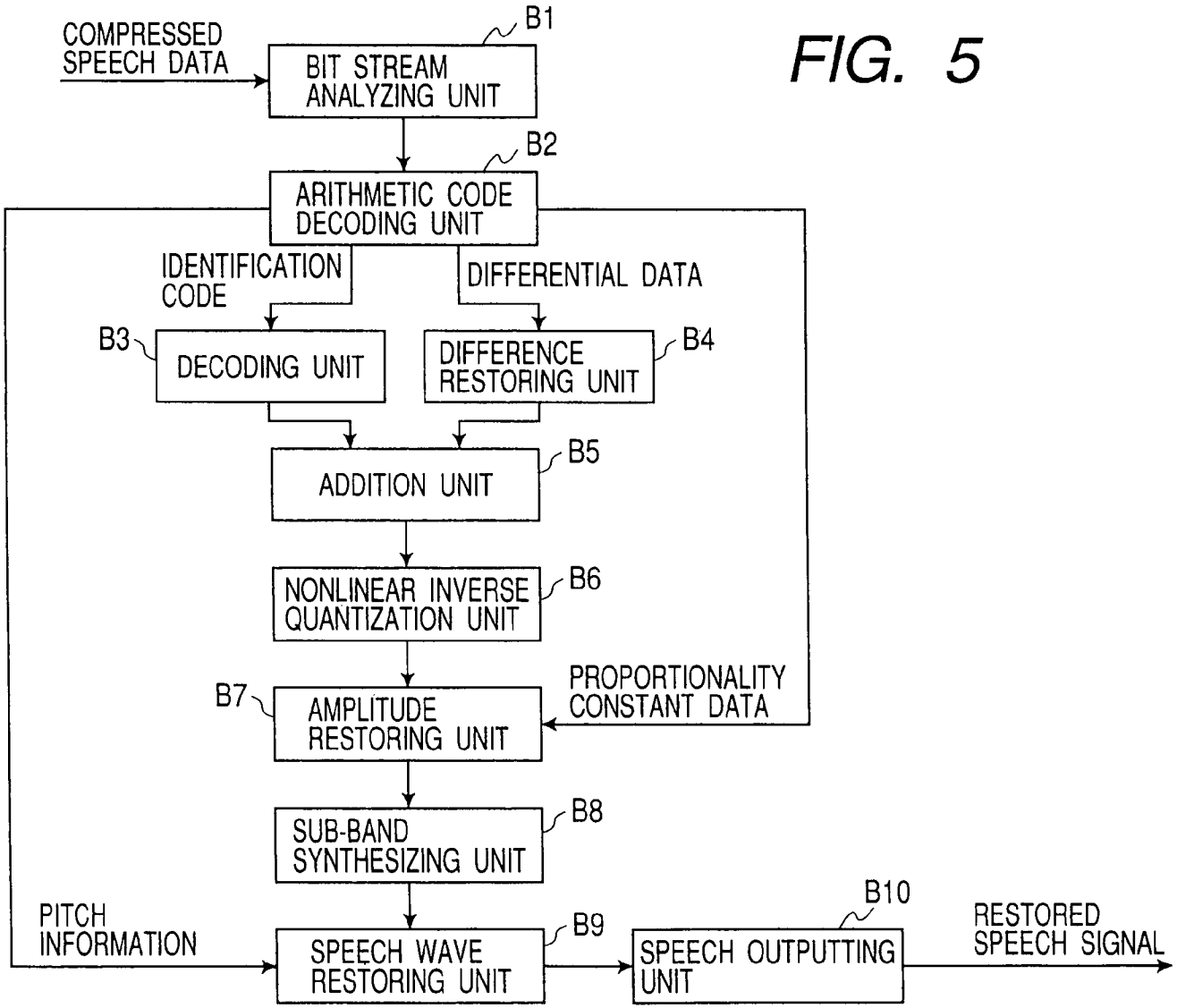
FIG. 5 is a block diagram showing a configuration of a speech signal expander according to the embodiment of this invention.

FIG. 5 shows a configuration of the speech signal expander. As shown in this figure, the speech signal expander is comprised of a bit stream decomposing unit B1, an arithmetic code decoding unit B2, a decoding unit B3, a difference restoring unit B4, an addition unit B5, a nonlinear inverse quantization unit B6, an amplitude restoring unit B7, a sub-band synthesizing unit B8, a speech wave restoring unit B9 and a speech voice outputting unit B10.

The bit stream decomposing unit B1 is comprised of, for example, a control circuit controlling serial communication with the outside in accordance with a specification such as RS232C, and a processor such as a CPU.

The bit stream decomposing unit B1 obtains a bit stream created by the bit stream forming unit A12 of the above described speech signal compressor (or bit stream having a data structure substantially identical to the bit stream created by the bit stream forming unit A12) from the outside. Then, the obtained bit stream is decomposed into an arithmetic code representing the identification code, an arithmetic code representing differential data and an arithmetic code representing pitch information, and the obtained arithmetic codes are supplied to the arithmetic code decoding unit B2.

The arithmetic code decoding unit B2, the decoding unit B3, the difference restoring unit B4, the addition unit B5, the nonlinear inverse quantization unit B6, the amplitude restoring unit B7, the sub-band synthesizing unit B8 and the speech wave restoring unit B9 are each constituted by a processor such as a DSP and a CPU.

Furthermore, part or all of functions of the arithmetic code decoding unit B2, the decoding unit B3, the difference restoring unit B4, the addition unit B5, the nonlinear inverse quantization unit B6, the amplitude restoring unit B7, the sub-band synthesizing unit B8 and the speech wave restoring unit B9 may be performed by a single processor.

The arithmetic code decoding unit B2 decodes the arithmetic code supplied from the bit stream decomposing unit B1 to restore the identification code, differential data, proportionality factor data and pitch information. Then, the restored identification code is supplied to the decoding unit B3, the restored differential data is supplied to the difference restoring unit B4, the restored proportionality factor data is supplied to the amplitude restoring unit B7, and the restored pitch information is supplied to the speech wave restoring unit B9.

The decoding unit B3 further comprises a storage apparatus constituted by a hard disk apparatus and the like in addition to the processor. The decoding unit B3 stores a phoneme dictionary substantially identical to that stored in the coding unit A7 of the above described speech signal compressor.

When the decoding unit B3 is supplied with the identification code from the arithmetic code decoding unit B2, the decoding unit B3 retrieves sub-band data assigned this identification code from the phoneme dictionary, and supplies the retrieved sub-band data to the addition unit B5.

When the difference restoring unit B4 is supplied with differential data from the arithmetic code decoding unit B3, the difference restoring unit B4 subjects this differential data to conversion substantially identical to the conversion carried out by the sub-band dividing unit A3 of the speech signal compressor described above, thereby creating data representing the intensity of each frequency component of this differential data. Then, the created data is supplied to the addition unit B5.

The addition unit B5 calculates the sum of the instantaneous value of the frequency component and the instantaneous value of the same frequency component represented by the data supplied from the difference restoring unit B4 for each frequency component represented by the sub-band data supplied from the decoding unit B3. Then, data representing sums calculated for all the frequency components is created and supplied to the nonlinear inverse quantization unit B6. This data supplied to the nonlinear inverse quantization unit B6 is equivalent to sub-band data after nonlinear compression obtained by subjecting sub-band data created based on speech data to be expanded to processing substantially identical to the processing carried out by the amplitude adjusting unit A4 and the nonlinear quantization unit A5 of the speech signal compressor described above.

When the nonlinear inverse quantization unit B6 is supplied with data from the addition unit B5, the nonlinear inverse quantization unit B6 changes the instantaneous value of each frequency component represented by this data, thereby creating data equivalent to sub-band data before being nonlinearly quantized, representing speech data to be expanded, and supplies the data to the amplitude restoring unit B7.

When the amplitude restoring unit B7 is supplied with sub-band data before being nonlinearly quantized from the nonlinear inverse quantization unit B6, and is supplied with proportionality factor data from the arithmetic code decoding unit B2, the amplitude restoring unit B7 multiplies the instantaneous value of each frequency component represented by the sub-band data by the inverse of the proportionality factor represented by the proportionality factor data to change the amplitude, and supplies sub-band data with the changed amplitude to the sub-band synthesizing unit B8.

When the sub-band synthesizing unit B8 is supplied with sub-band data with the changed amplitude from the amplitude restoring unit B7, the sub-band synthesizing unit B8 subjects the sub-band data to conversion substantially identical to the conversion carried out by the decoding unit A8 of the speech signal compressor described above, thereby restoring pitch wave data with the intensity of each frequency component represented by the sub-band data. Then, the restored pitch wave is supplied to the speech wave restoring unit B9.

The speech wave restoring unit B9 changes the time length of each section of pitch wave data supplied from the sub-band synthesizing unit B8 so that the time length equals the time length shown by pitch information supplied from the arithmetic code decoding unit B2. The changing of the time length of the section may be carried out by, for example, changing the space between samples existing in the section.

Then, the speech wave restoring unit B9 supplies pitch wave data with the time length of each section changed (i.e. speech data representing the restored speech sound) to the speech sound outputting unit B10.

The speech sound outputting unit B10 comprises, for example, a control circuit performing the function of a PCM decoder, a D/A (digital-to-Analog) converter, an AF (Audio Frequency) amplifier, a speaker and the like.

When the speech sound outputting unit B10 is supplied with speech data representing the restored speech sound from the speech wave restoring unit B9, the speech sound outputting unit B10 demodulates the speech data, D/A converts and amplifies the speech data, and uses the obtained analog signal to drive a speaker, thereby playing back the speech sound.

Furthermore, the configuration of this speech signal expander is not limited to that described above.

For example, the bit stream decomposing unit B1 may obtain speech data from the outside via the communication line. In this case, the bit stream decomposing unit B1 is simply provided with a communication controlling unit constituted by, for example, a modem, a DSU and the like.

In addition, the bit stream decomposing unit B1 may comprise, for example, a recording medium driver and in this case, the bit stream decomposing unit B1 may obtain compressed speech data by reading the data from a recording medium in which this compressed speech data is recorded.

In addition, the speech sound outputting unit B10 may output compressed speech data to the outside via a communication line or the like. In the case where data is outputted via the communication line, the speech sound outputting unit B10 is simply provided with a communication controlling unit constituted by, for example, a modem, a DSU and the like.

In addition, the speech sound outputting unit B10 may comprise a recording medium driver and in this case, the speech sound outputting unit B10 may write data to be stored in the phoneme dictionary in the storage area of a recording medium set in the recording medium driver.

Furthermore, a single modem, DSU or recording medium driver may constitute the bit stream decomposing unit B1 and the speech sound outputting unit B10.

In addition, the differential data may represent the result of determining a difference between the intensity of each frequency component of a speech sound to be compressed and the intensity of each frequency component of another speech sound serving as a reference speech sound for each set of components having the same frequency (e.g. differential data created as data representing each difference obtained in such a manner that the difference calculating unit A9 of the speech signal compressor described above determines a difference between the instantaneous value of the intensity of each frequency component represented by sub-band data after nonlinear quantization created by the nonlinear quantization unit A5 and the instantaneous value of the intensity of each frequency component represented by sub-band data identified by the coding unit A7 for each set of components having the same frequency).

In this case, the addition unit B5 may obtain differential data from the arithmetic code decoding unit B2, calculate the sum of the instantaneous value of the frequency component and the instantaneous value of the same frequency component represented by the differential data obtained from the arithmetic code decoding unit B2 for each frequency component represented by the sub-band data supplied from the decoding unit B3, create data representing sums calculated for all the frequency components, and supply the data to the nonlinear inverse quantization unit B6.

In addition, predetermined data showing that a wave identical to the immediately preceding wave follows in succession may be included in compressed speech data in place of the identification code.

In this case, the arithmetic code decoding unit 2 may determine whether or not the predetermined data is included and notify, for example, the speech sound outputting unit B10 that a wave identical to the immediately preceding wave follows in succession if it is determined that the predetermined data is included. On the other hand, for example, the speech sound outputting unit B10 may comprise a storage unit for storing the newest speech data of speech data supplied from the speech wave restoring unit B9 in the past. In this case, when the speech sound outputting unit B10 is notified by the arithmetic code decoding unit 2 that a wave identical to the immediately preceding wave follows in succession, the speech sound outputting unit B10 may play back the speech sound represented by speech data stored in the speech sound outputting unit B10.

The embodiment of this invention has been described above, but the speech signal compressing apparatus and the speech signal expanding apparatus according to this invention can be achieved using a usual computer system instead of a dedicated system.

For example, a programs for executing the operations of the above described speech sound inputting unit A1, pitch wave extracting unit A2, sub-band dividing unit A3, amplitude adjusting unit A4, nonlinear quantization unit A5, linear prediction analysis unit A6, coding unit A7, decoding unit A8, difference calculating unit A9, quantization unit A10, arithmetic coding unit A11 and bit stream forming unit A12 is installed in a personal computer from a medium (CD-ROM, MO, flexible disk, etc.) storing the program, whereby a speech signal compressor performing the above described processing can be built.

In addition, a programs for executing the operations of the above described bit stream decomposing unit B1, arithmetic code decoding unit B2, decoding unit B3, difference restoring unit B4, addition unit B5, nonlinear inverse quantization unit B6, amplitude restoring unit B7, sub-band synthesizing unit B8, speech wave restoring unit B9 and speech voice outputting unit B10 is installed in a computer from a medium storing the program, whereby a speech signal expander performing the above described processing can be built.

In addition, for example, these programs may be published on a bulletin board system (BBS) of a communication line and delivered via the communication line, or these programs may be restored in such a manner that a carrier wave is modulated by a signal representing this program, the modulated wave obtained is transmitted, and the apparatus receiving this modulated wave demodulates the modulated wave.

Then, this program is started, and is executed in the same way as other application programs under the control by the OS, whereby the above described processing can be performed.

Furthermore, if the OS performs part of processing, or the OS constitutes one element of this invention, a program from which such part is removed may be stored in the recording medium. Also in this case, in this invention, a program for performing each function or step carried out by the computer is stored in the recording medium.

Third Invention

The embodiment of the third invention will be described using a speech dictionary creating system and a speech synthesizing system as an example.

Speech Dictionary Creating System

Figure 6:
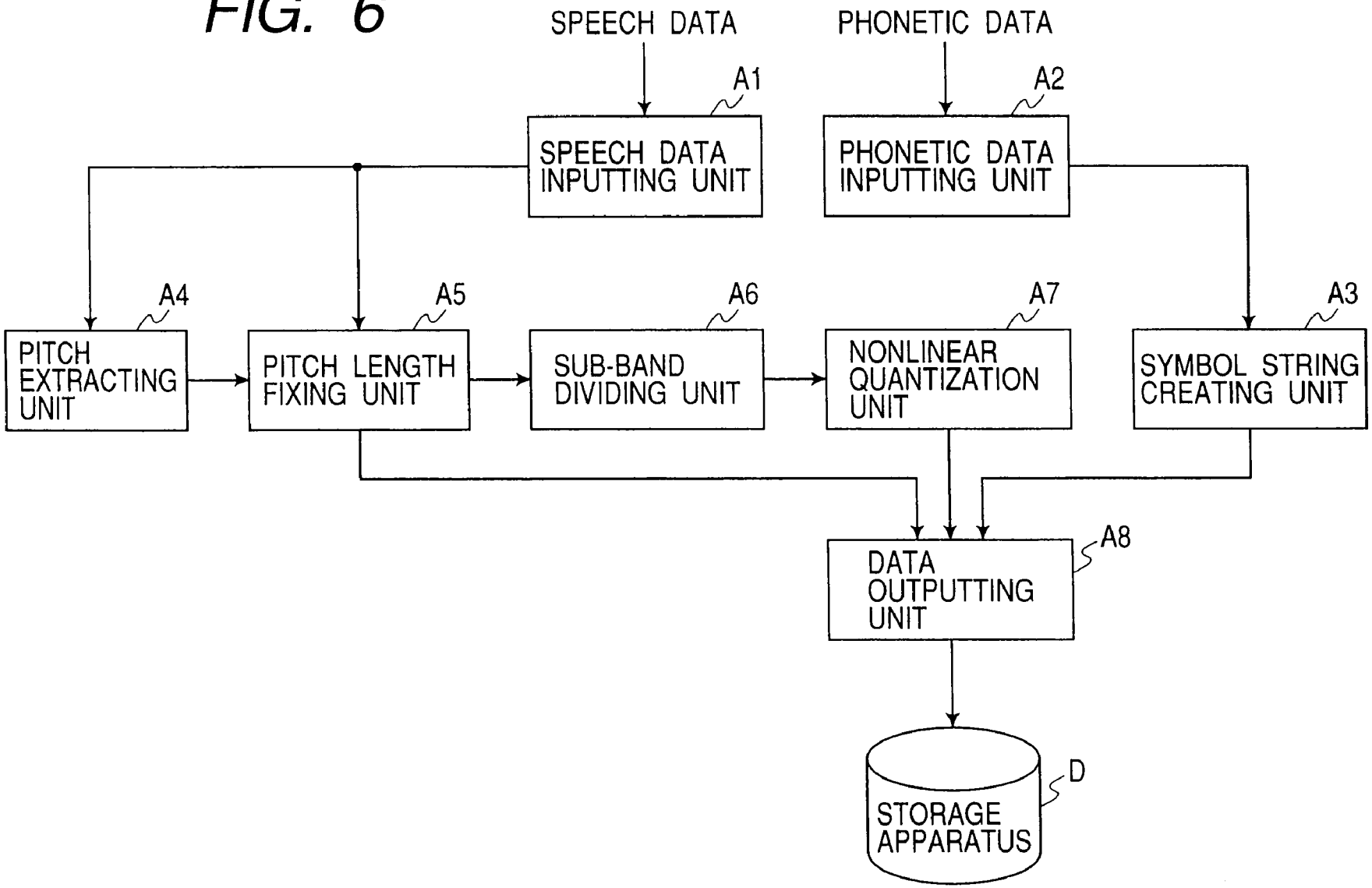
FIG. 6 is a block diagram showing a configuration of speech dictionary creating system according to the embodiment of this invention.

FIG. 6 shows a configuration of the speech dictionary creating system according to the embodiment of this invention. As shown in this figure, this speech dictionary creating system is comprised of a speech data inputting unit A1, a phonetic data inputting unit A2, a symbol string creating unit A3, a pitch extracting unit A4, a pitch length fixing unit A5, a sub-band dividing unit A6, a nonlinear quantization unit A7 and a data outputting unit A8.

The speech data inputting unit A1 and the phonetic data inputting unit A2 are each comprised of, for example, a recording medium driver (flexible disk drive, MO drive, etc.) for reading data recorded in a recording medium (e.g. flexible disk and MO (Magneto Optical disk), etc.) and the like. Furthermore, the functions of the speech data inputting unit A1 and the phonetic data inputting unit A2 may be performed by a single recording medium driver.

The speech data inputting unit A1 obtains speech data representing the wave of a speech sound, and supplies the speech data to the pitch extracting unit A4 and the pitch length fixing unit A5.

Furthermore, the speech data has a format of a PCM (Pulse Code Modulation)-modulated digital signal, and represents a speech sound sampled in a fixed period much shorter than the pitch of the speech sound.

The phonetic data inputting unit A2 inputs phonetic data in which a string of phonetic symbols showing the pronunciation of the speech sound is shown in the text format or the like, and supplies the phonetic data to the symbol string creating unit A3.

The symbol string creating unit A3 is comprised of a processor such as a CPU (Central processing unit) and the like.

The symbol string creating unit A3 analyzes phonetic data supplied from the phonetic data inputting unit A2, and creates a pronunciation symbol string representing the speech sound represented by the phonetic data as a string of pronunciation symbols showing the pronunciation of a unit speech sound constituting the speech sound. In addition, the symbol string creating unit A3 analyzes this phonetic data, and creates a rhythm symbol string representing the rhythm of the speech sound represented by the phonetic data as a string of rhythm symbols showing the rhythm of the unit speech sound Then, the symbol string creating unit A3 supplies the created pronunciation symbol string and rhythm symbol string to the data outputting unit A8.

Furthermore, the unit speech sound is a speech sound functioning as a unit constituting a linguistic sound, and for example, the CV (Consonant-Vowel) unit consisting of one consonant combined with one vowel functions as a unit speech sound.

The pitch extracting unit A4, the pitch length fixing unit A5, the sub-band dividing unit A6 and the nonlinear quantization unit A7 are each comprised of a data processor such as a DSP (Digital Signal Processor) and a CPU.

Furthermore, part or all of functions of the pitch extracting unit A4, the pitch length fixing unit A5, the sub-band dividing unit A6 and the nonlinear quantization unit A7 may be performed by a single data processor.

The pitch extracting unit A4 is comprised of elements (1 to 7) shown in FIG. 1 as in the case of first and second inventions. The pitch extracting unit A4 analyzes speech data supplied from the speech data inputting unit A1, and identifies a section equivalent to a unit pitch (e.g. one pitch) of a speech sound represented by the speech data. Then, timing data showing the timing of the head and end of each identified section is supplied to the pitch length fixing unit A5.

Then, the pitch length fixing unit A5 determines correlation between speech data in the section of which phase is changed in a variety of ways and the pitch signal in the section for each divided section, and identifies the phase of speech data providing the highest correlation as the phase of speech data in this section. Then, the phase of speech data in each section is shifted so that the phase equals the identified phase.

Furthermore, it is desirable that the temporal length of the section is equivalent to about one pitch. As the length of the section increases, the number of samples in the section is increased and thus the data amount of pitch wave data (described later) is increased, or the number of intervals at which sampling is performed is increased, so that a speech sound represented by pitch wave data becomes inaccurate.

Then, the pitch length fixing unit A5 makes the time length of each section substantially identical with each other by resampling each phase-shifted section. Then, speech data having the time length uniformalized (pitch wave data) is supplied to the sub-band dividing unit A6.

In addition, the pitch length fixing unit A5 creates pitch information showing the original number of samples in each section of this speech data (the number of samples in each section of this speech data at the time when the speech data was supplied from the speech data inputting unit A1 to the pitch length fixing unit A5) and supplies the pitch information to the data outputting unit A8. Provided that the interval at which the speech data obtained by the speech data inputting unit A1 is sampled is known, the pitch information functions as information showing the original time length of the section equivalent to the unit pitch of this speech data.

The sub-band dividing unit A6 subjects pitch wave data supplied from the pitch length fixing unit A5 to orthogonal transformation such as DCT (Discrete Cosine Transform), thereby creating spectrum information. Then, the created spectrum information is supplied to the nonlinear quantization unit A7.

The spectrum information is data including data showing variation with time in the intensity of the fundamental frequency component of the speech sound represented by the pitch wave signal and n data showing variation with time in the intensity of n fundamental frequency components of this speech sound (n is a natural number). Therefore, the spectrum information represents the intensity of the fundamental frequency component 'harmonic wave component) in the form of a direct current signal when there is no variation with time in the intensity of the fundamental frequency component (or harmonic wave component) of the speech sound.

When the nonlinear quantization unit A7 is supplied with spectrum information from the sub-band unit A6, the nonlinear quantization unit A7 creates spectrum information equivalent to a value obtained by quantizing a value obtained by subjecting the instantaneous value of each frequency component represented by the spectrum information to nonlinear compression (specifically, value obtained by substituting the instantaneous value into an upward convex function, for example), and supplies the created spectrum information (spectrum information after nonlinear quantization) to the data outputting unit A8.

Specifically, for example, the nonlinear quantization unit A7 may carry out nonlinear compression by changing the instantaneous value of each frequency component after nonlinear compression to a value substantially equivalent to a value obtained by quantizing the function Xri (xi) shown in the right-hand side of formula 1.

$$Xri(xi)=sgn(xi)\cdot|xi|^{4/3}\cdot 2^{(global\ gain(xi))/4} \quad \text{[Formula 3]}$$

wherein sgn (a)=(a/|a|), xi is the original instantaneous value of the frequency component represented by spectrum information, and global_gain (xi) is a function of xi for setting a full scale.

In addition, the nonlinear quantization unit A7 creates data showing the type of characteristics of nonlinear quantization applied to the spectrum information as data (compressed information) for restoring a nonlinearly quantized value to the original value, and supplies this compressed information to the data outputting unit A8.

The data outputting unit A8 is comprised of a control circuit controlling access to an external storage apparatus (e.g. hard disk apparatus) D in which the speech dictionary is stored, such as a hard disk controller, and the like, and is connected to the storage device D.

When the data outputting unit A8 is supplied with the pronunciation symbol string and the rhythm symbol string from the symbol string creating unit A3, is supplied with pitch information from the pitch length fixing unit A5, and is supplied with compressed information and spectrum information after nonlinear compression from the nonlinear quantization unit A7, the data outputting unit A8 stores the supplied pronunciation symbol string and rhythm symbol string, pitch information, compressed information and spectrum information after nonlinear compression in the storage area of the storage apparatus D in such a manner that the above strings and information representing the same speech sound are brought into correspondence with one another.

A collection of sets of pronunciation symbol strings, rhythm symbol strings, pitch information, compressed information and spectrum information after nonlinear compression brought into correspondence with one another and stored in the storage apparatus D constitutes the speech dictionary.

Speech Synthesizing System

The speech synthesizing system according to the embodiment of this invention will now be described.

Figure 7:
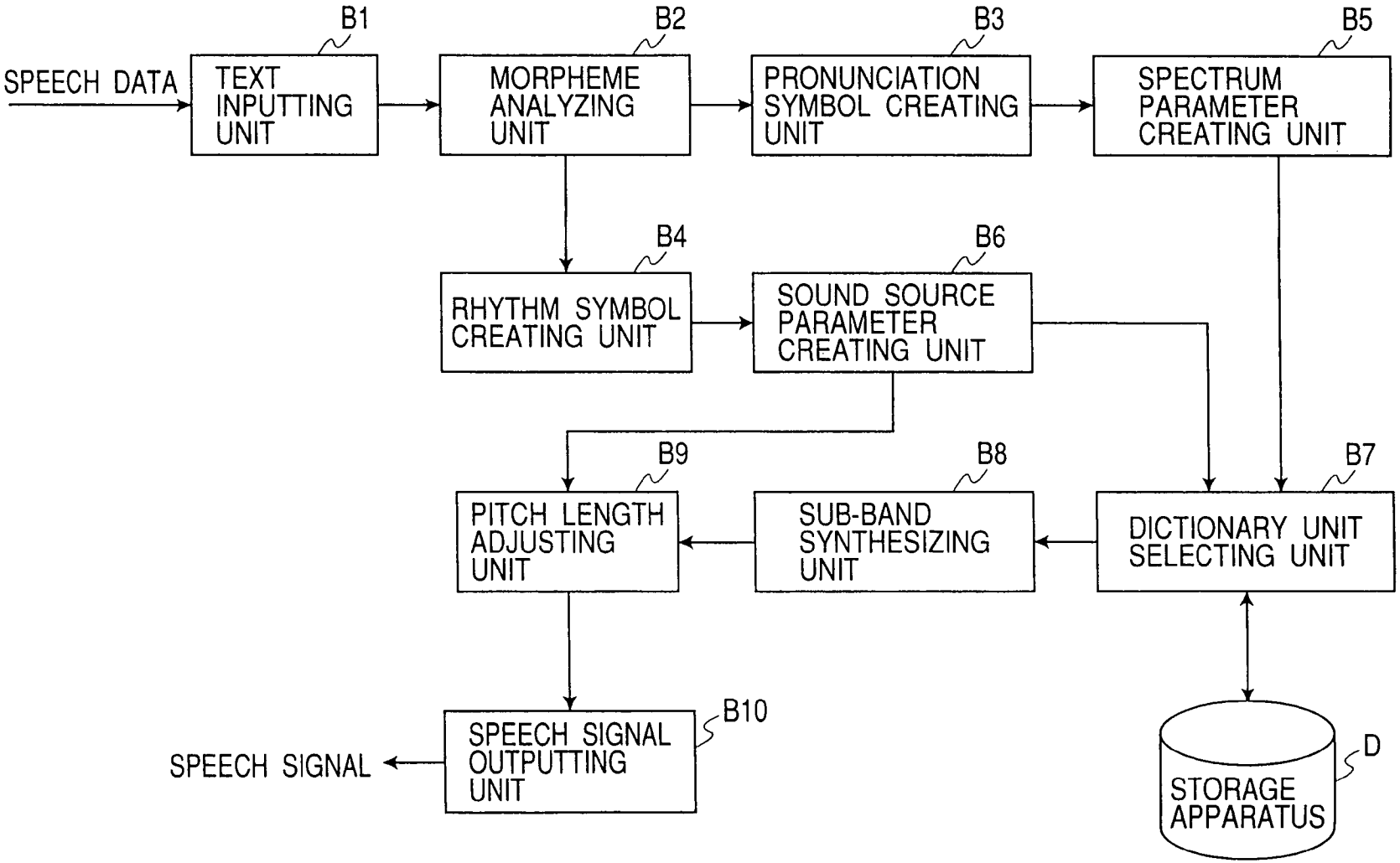
FIG. 7 is a block diagram showing a configuration of a speech synthesizing system according to the embodiment of this invention.
Figure 8:
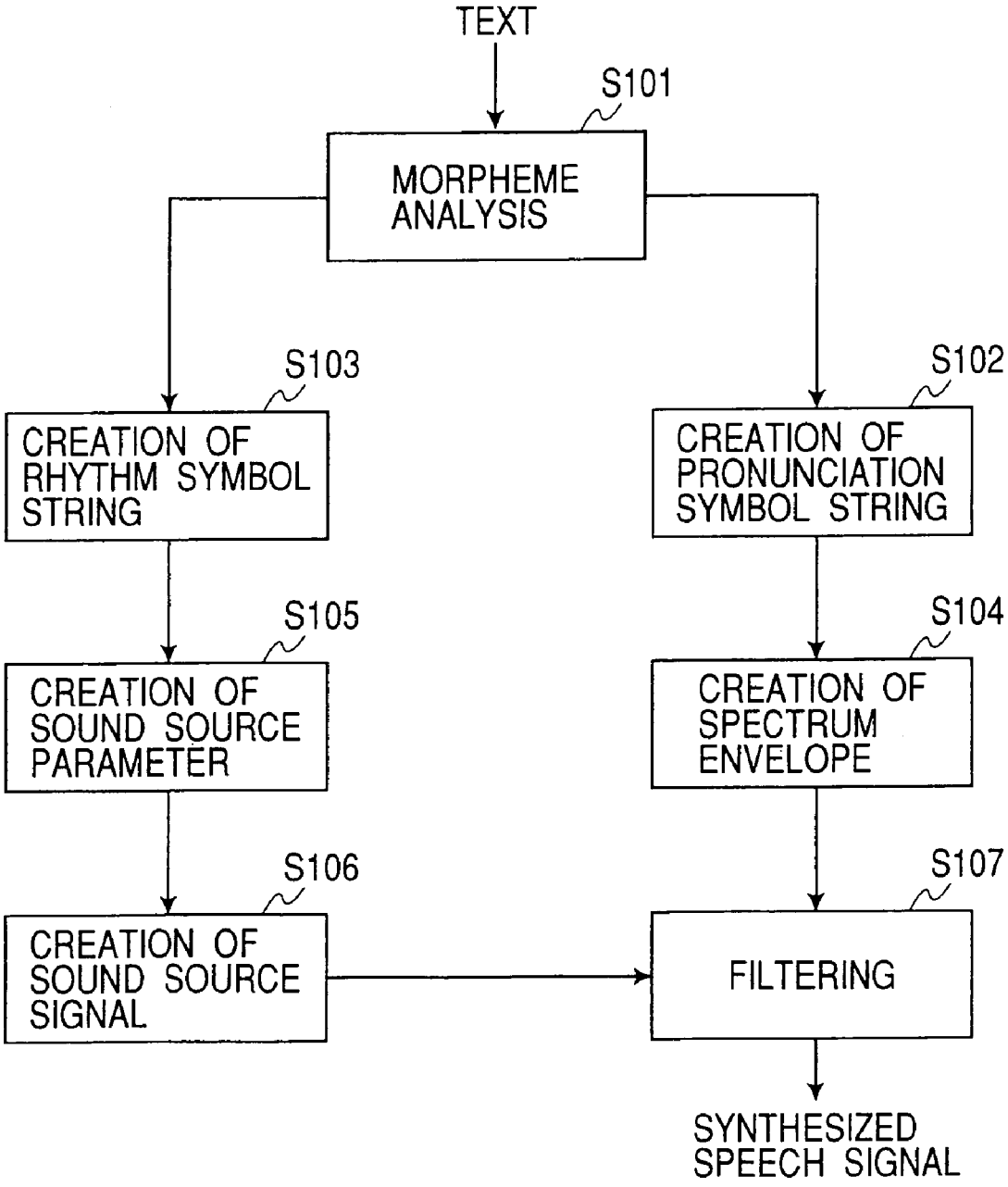
FIG. 8 illustrates a procedure of speech synthesis by a rule synthesis method.
Figure 9:
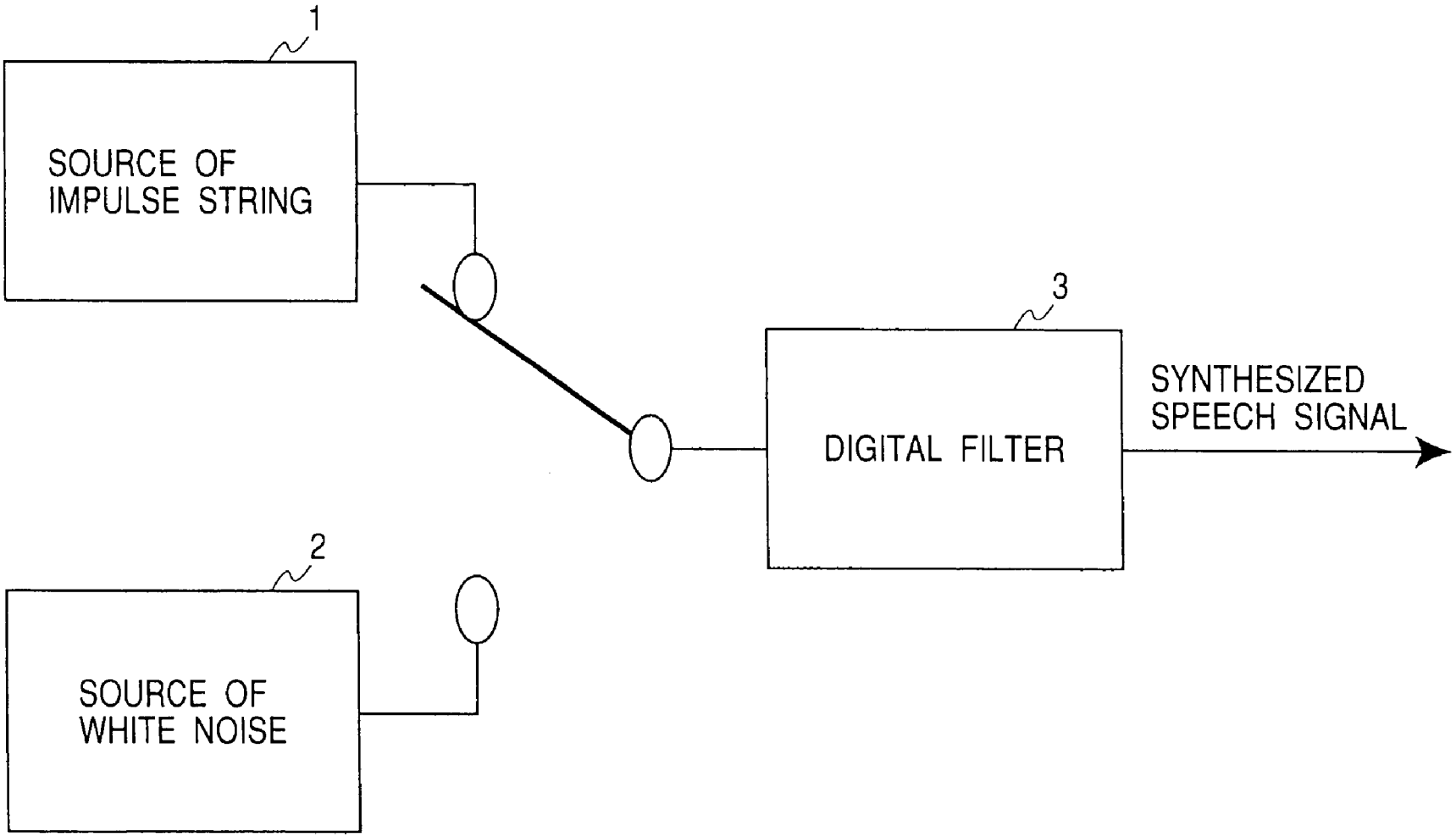
FIG. 9 schematically illustrates the concept of speech synthesis.

FIG. 7 shows a configuration of this speech synthesizing system. As shown in this figure, the speech synthesizing system is comprised of a text inputting unit B1, a morpheme analyzing unit B2, a pronunciation symbol creating unit B3, a rhythm symbol creating unit B4, a spectrum parameter creating unit B5, a sound source parameter creating unit B6, a dictionary unit selecting unit B7, a sub-band synthesizing unit B8, a pitch length adjusting unit B9 and a speech sound outputting unit B10.

The text inputting unit B1 is comprised of, for example, a recording medium driver.

The text inputting unit B1 obtains externally text data describing a text for which a speed sound is synthesized, and supplies the text data to the morpheme analyzing unit B2.

The morpheme analyzing unit B2, the pronunciation symbol creating unit B3, the rhythm symbol creating unit B4, the spectrum parameter creating unit B5 and the sound source parameter creating unit B6 are each comprised of a data processor such as a CPU.

Furthermore, part or all of functions of the morpheme analyzing unit B2, the pronunciation symbol creating unit B3, the rhythm symbol creating unit B4, the spectrum parameter creating unit B5 and the sound source parameter creating unit B6 may a single data processor.

The morpheme analyzing unit B2 subjects the text represented by text data supplied from the text inputting unit B1 to morpheme analysis, and decomposes this text into strings of morphemes. Then, data representing the obtained strings of morphemes are supplied to the pronunciation symbol creating unit B3 and the rhythm symbol creating unit B4.

The pronunciation symbol creating unit B3 creates data representing a string of pronunciation symbols (e.g. phonetic symbol such as kana characters) representing unit speech sounds constituting the speech sound to be synthesize in the order of pronunciation based on the string of morphemes represented by the data supplied from the morpheme analyzing unit B2, and supplies the data to spectrum parameter creating unit B5.

The rhythm symbol creating unit B4 subjects the string of morphemes represented by the data supplied from the morpheme analyzing unit B2 to analysis based on, for example, the Fujisaki model, thereby identifying the rhythm of this string of morphemes, and creates data representing a string of rhythm symbols representing the identified rhythm, and supplies the data to the sound source parameter creating unit B6.

The spectrum parameter creating unit B5 identifies the spectrum of the unit speech sound represented by pronunciation symbols represented by the data supplied from the pronunciation symbol creating unit B3, and supplies spectrum information representing the identified spectrum and the supplied pronunciation symbols to the dictionary unit selecting unit B7.

Specifically, for example, the spectrum parameter creating unit B5 stores in advance a spectrum table storing pronunciation symbols for reference and spectrum information representing the spectrum of the speech sound represented by the pronunciation symbols for reference with the symbols and information brought into correspondence with each other. Then, spectrum information brought into correspondence with the pronunciation symbols is retrieved from the spectrum table (i.e. identifies the spectrum of the unit speech sound represented by the pronunciation symbols represented by data supplied from the pronunciation symbol creating unit B3) using as a key the pronunciation symbols represented by data supplied from the pronunciation symbol creating unit B3, and the retrieved spectrum information is supplied to the dictionary unit selecting unit B7.

In this case, however, the spectrum parameter creating unit B5 further comprises a storage apparatus such as a hard disk apparatus and a ROM (Read Only Memory) in addition to the data processor.

The sound source parameter creating unit B6 identifies a parameter (e.g. pitch of unit speech sound, power and duration) characterizing the rhythm represented by rhythm symbols represented by data supplied from the rhythm symbol creating unit B4, and supplies data rhythm information representing the identified parameter to the dictionary unit selecting unit B7 and the pitch length adjusting unit 10.

Specifically, for example, the sound source parameter creating unit B6 stores in advance a rhythm table storing rhythm symbols for reference and rhythm information representing a parameter characterizing the rhythm represented by the rhythm symbols for reference with the symbols and information brought into correspondence with each other. Then, rhythm information brought into correspondence with the rhythm symbols is retrieved from the rhythm table (i.e. identifies the parameter characterizing the rhythm represented by the rhythm symbols represented by data supplied from the rhythm symbol creating unit B4) using as a key the rhythm symbols represented by data supplied from the symbol creating unit B4, and the retrieved rhythm information is supplied to the dictionary unit selecting unit B7.

In this case, however, the sound source parameter creating unit B6 further comprises a storage apparatus such as a hard disk apparatus and a ROM in addition to the data processor. Furthermore, a single storage apparatus may perform the functions of the storage apparatus of the spectrum parameter creating unit B5 and the storage apparatus of the sound source parameter creating unit B6.

The dictionary unit selecting unit B7, the sub-band synthesizing unit B8 and the pitch length adjusting unit B9 are each comprised of a data processor such as a DSP and a CPU.

Furthermore, part or all of functions of the dictionary unit selecting unit B7, the sub-band synthesizing unit B8 and the pitch length adjusting unit B9 may be performed by a single data processor. Also, the data processor performing part or all of functions of the morpheme analyzing unit B2, the pronunciation symbol creating unit B3, the rhythm symbol creating unit B4, the spectrum parameter creating unit B5 and the sound source parameter creating unit B6 may perform part or all of functions of the dictionary unit selecting unit B7, the sub-band synthesizing unit B8 and the pitch length adjusting unit B9.

The dictionary unit selecting unit B7 is connected to an external storage apparatus D storing a speech dictionary (or a set of data having a data structure substantially identical to that of the speech dictionary) created by the speech dictionary creating system of FIG. 6 described above. Here, the storage apparatus D stores the speech dictionary (or a set of data having a data structure substantially identical to that of the speech dictionary) created by the speech dictionary creating system of FIG. 6 described above. That is, the storage apparatus D stores a string of pronunciation symbols representing unit sound, a string of rhythm symbols, pitch information, compressed information and spectrum information after nonlinear compression representing a unit speech sound, with the symbols and information brought into correspondence with one another.

When the dictionary unit selecting unit B7 is supplied with pronunciation symbols and spectrum information from the spectrum parameter creating unit B5, and is supplied with rhythm information from the sound source parameter creating unit B6, the dictionary unit selecting unit B7 identifies from the speech dictionary a set of pronunciation symbol string, rhythm symbol string, pitch information, compressed information and spectrum information after nonlinear compression representing a unit speech sound that can be most approximated to the speech sound represented by these supplied data.

Specifically, for example, the dictionary unit selecting unit B7

(a) determines, for spectrum information and pitch information of the same unit speech sound stored in the speech dictionary, a coefficient of correlation between the value of this spectrum information and spectrum information supplied from the spectrum parameter creating unit B5, and a coefficient of correlation between the value of this pitch information and the value of the pitch shown by rhythm information supplied from the sound source parameter creating unit B6, and calculates the average of the determined coefficients of correlation; and (b) carries out the processing of (a) described above for all unit speech sounds of which parameters are stored in the speech dictionary, and then identifies a unit speech sound for which the average calculated in the processing of (a) is the largest of the unit speech sounds as a unit speech sound closest to the unit speech sound represented by the parameters supplied from the spectrum parameter creating unit B5 and the sound source parameter creating unit B6.

Then, the dictionary unit selecting unit B7 supplies spectrum information and compressed information representing the identified unit speech sound to the sub-band synthesizing unit B8.

The sub-band synthesizing unit B8 restores the intensity of each frequency component represented by spectrum information supplied from the dictionary unit selecting unit B7 to the value of intensity before being nonlinearly quantized with characteristics represented by compressed information supplied from the dictionary unit selecting unit B7. Then, the spectrum information with the value of intensity restored is subjected to transformation, whereby pitch wave data in which the intensity of each frequency component after nonlinear quantization is represented by this spectrum information is restored. Then, the restored pitch wave data is supplied to the pitch length adjusting unit B9. Furthermore, this pitch wave data has, for example, a form of a PCM-modulated digital signal.

The transformation applied to spectrum information by the sub-band synthesizing unit B8 is substantially in inverse relationship with the transformation applied to the wave of the phoneme to create this spectrum information. Specifically, for example, if this spectrum information is information created by subjecting the phoneme to DCT, the sub-band synthesizing unit B8 may subject this spectrum information to IDCT (Inverse DCT).

The pitch length adjusting unit B9 changes the time length of each section of pitch wave data supplied from the sub-band synthesizing unit B8 so that it equals the time length of the pitch shown by rhythm information supplied from the sound source parameter creating unit B6. The change of the time length of the section may be carried out by, for example, changing the space between samples existing in the section.

Then, the pitch length adjusting unit B9 supplies the pitch wave data with the time length of each section changed (i.e. speech data representing a synthesized speech sound) to the speech sound outputting unit B10.

The speech sound outputting unit B10 comprises, for example, a control circuit performing the function of a PCM decoder, a D/A (Digital-to-Analog) converter, an AF (Audio Frequency) amplifier, a speaker and the like.

When the speech sound outputting unit B10 is supplied with speech data representing a synthesized speech sound from the pitch length adjusting unit B9, the speech sound outputting unit B10 demodulates this speech data, D/A-converts and amplifies, and uses the obtained analog signal to drive the speaker, thereby playing back the synthesized speech sound.

The spectrum information stored in the speech dictionary created by the speech dictionary creating system described above is created based on speech data in which the time length of the section equivalent to the unit pitch is normalized and the influence of fluctuation of the pitch is eliminated. Therefore, this spectrum information accurately shows the variation with time in intensity of each frequency component (fundamental frequency component and harmonic wave component) of speech sound. In addition, information representing the original time length of each section of a unit speech sound having a fluctuation is stored in this speech dictionary.

Thus, the speech sound synthesized by the above described speech synthesizing system using this speech dictionary is close to a speech sound actually produced by man.

Furthermore, the configurations of the speech dictionary creating system and the speech synthesizing system are not limited to those described above.

For example, the speech data inputting unit A1 may obtain speech data from the outside via a communication line such as a telephone line, a dedicated line and a satellite line. In this case, the speech data inputting unit A1 is simply provided with a communication controlling unit constituted by, for example, a modem, a DSU (Data Service Unit) and the like.

In addition, the speech data inputting unit A1 may comprise a sound collecting apparatus constituted by a microphone, an AF amplifier, a sampler, an A/D (Analog-to-digital) converter, a PCM encoder and the like. The sound collecting apparatus may amplify, sample and do A/D-convert a speech signal representing a speech sound collected by its own microphone, and thereafter subject the sampled speech signal to PCM modulation, thereby obtaining speech data. Furthermore, the speech data obtained by the speech data inputting unit A1 is not necessarily a PCM signal.

In addition, the pitch extracting unit A4 does not need to comprise a cepstrum analyzing unit A41 (or self correlation analyzing unit A42) and in this case, a weight calculating unit A43 may directly deal with as an average pitch length the inverse of the fundamental frequency determined by the cepstrum analyzing unit A41 (or self correlation analyzing unit A42).

In addition, a zero cross analyzing unit A46 may supply the pitch signal supplied from a band pass filter A45 directly to a BPF coefficient calculating unit A44 as a zero cross signal.

In addition, the data outputting unit A8 may output data to be stored in the speech dictionary to the outside via a communication line or the like. In the case where data is outputted via the communication line, the data outputting unit A8 is simply provided with a communication controlling unit constituted by, for example, a modem, a DSU and the like.

In addition, the data outputting unit A8 may comprise a recording medium driver and in this case, the data outputting unit A8 may write data to be stored in the speech dictionary in the storage area of a recording medium set in the recording medium driver.

Furthermore, a single modem, DSU or recording medium driver may constitute the speech data inputting unit A1 and the data outputting unit A8.

In addition, the text inputting unit B1 may obtain text data from the outside via a communication line or the like. In this case, the text inputting unit B1 is simply provided with a communication controlling unit constituted by a modem, a DSU and the like.

In addition, the dictionary unit selecting unit B7 may identify a unit speech sound that can be most approximated to the speech sound represented by data supplied to itself in such a manner as to attach greater importance to some information than other information.

Specifically, for example, the dictionary unit selecting unit B7 may multiply a coefficient a of correlation between the value of spectrum information stored in the speech dictionary and the value of spectrum information supplied from the spectrum parameter creating unit B5 by a weight factor $\beta$ larger than 1, and use the obtained value ($\alpha \cdot \beta$) in place of the value $\alpha$ when the average value of the coefficient of correlation is calculated for attaching greater importance to spectrum information than pitch information in the processing of (a) described above.

The embodiment of this invention has been described above, but the speech synthesizing apparatus and the speech dictionary creating apparatus according to this invention can be achieved using a usual computer system instead of a dedicated system.

For example, a programs for executing the operations of the above described speech data inputting unit A1, phonetic data inputting unit A2, symbol string creating unit A3, pitch extracting unit A4, pitch length fixing unit A5, sub-band dividing unit A6, nonlinear quantization unit A7 and data outputting unit A8 is installed in a personal computer from a medium (CD-ROM, MO, flexible disk, etc.) storing the program, whereby a speech dictionary creating system performing the above described processing can be built.

In addition, a programs for executing the operations of the above described text inputting unit B1, morpheme analyzing unit B2, pronunciation symbol creating unit B3, rhythm symbol creating unit B4, spectrum parameter creating unit B5, sound source parameter creating unit B6, dictionary unit selecting unit B7, sub-band synthesizing unit B8, pitch length adjusting unit B9 and speech sound outputting unit B10 is installed in a personal computer from a medium storing the program, whereby a speech synthesizing system performing the above described processing can be built.

In addition, for example, these programs may be published on a bulletin board system (BBS) of a communication line and delivered via the communication line, or these programs may be restored in such a manner that a carrier wave is modulated by a signal representing this program, the modulated wave obtained is transmitted, and the apparatus receiving this modulated wave demodulates the modulated wave.

Then, this program is started, and is executed in the same way as other application programs under the control by the OS, whereby the above described processing can be performed.

Furthermore, if the OS performs part of processing, or the OS constitutes part of one element of this invention, a program from which such part is removed may be stored in the recording medium. Also in this case, in this invention, a program for performing each function or step carried out by the computer is stored in the recording medium.

INDUSTRIAL APPLICABILITY

As described above, according to the first invention, a pitch wave signal creating apparatus and a pitch wave signal creation method functioning effectively as a preliminary process for efficiently coding a speech signal with a pitch having a fluctuation are achieved. Also, according to the second invention, a speech signal compressing apparatus efficiently compressing data representing a speech sound or compressing data representing a speech sound having a fluctuation in high sound quality, a speech signal expanding apparatus, a speech signal compression method and a speech signal expansion method are achieved.

In addition, according to the third invention, a speech synthesizing apparatus for synthesizing a natural speech sound, a speech dictionary creating apparatus, a speech synthesis method and a speech dictionary creation method are achieved.

What is claimed is:

1. A speech synthesizing apparatus, the apparatus comprising:

division means for dividing an input speech signal into a plurality of unit speech samples;

signal creating means for creating a pitch wave signal from each of the unit speech samples, the pitch wave signal comprising a plurality of normalized pitch wave elements which have a substantially identical time length and uniform phase, wherein the pitch wave signal is created in such a way that a pitch signal representing pitch periods in the unit speech sample is generated and the phase of a speech wave in each pitch period is shifted so as to maximize the correlation between the speech wave in the pitch period and the pitch signal and that the phase shifted speech wave in each pitch period is resampled with the same number of samples to make uniform the time length of the speech wave in each pitch period to the same time length;

storage means for storing rhythm information representing the rhythm of each unit speech sample, pitch information representing the pitch of the sample, the spectrum information showing variation with time in the fundamental frequency component and harmonic wave component of the pitch wave signal in such a manner that each of the rhythm information, the pitch information and the spectrum information corresponds to the sample;

prediction means for inputting text information representing a text, and creating prediction information representing the result of predicting the pitch and spectrum of a unit speech constituting the text based on the text information;

retrieval means for identifying a sample having a pitch and spectrum having the highest correlation with the pitch and spectrum of the unit speech constituting the text based on the pitch information, spectrum information and prediction information; and signal synthesizing means for creating a synthesized speech signal representing a speech in which the speech has a rhythm represented by the rhythm information brought into correspondence with the sample identified by the retrieval means, the variation with time in the fundamental frequency component and harmonic wave component is represented by the spectrum information brought into correspondence with the sample identified by the retrieval means, and the time length of one pitch period is a time length represented by the pitch information brought into correspondence with the sample identified by the retrieval means.

2. The speech synthesizing apparatus according to claim 1, wherein the spectrum information is constituted by data representing the result of nonlinearly quantizing the value representing variation with time in the fundamental frequency component and harmonic wave component of the pitch wave signal, and wherein the phase to be shifted of the speech wave in one pitch period has a value of $\phi$ giving the maximum cor, in accordance with the following expression:

$$cor = \sum_{i=1}^{n} \{f(i-\varphi) \cdot g(i)\}$$

(where, n is a total number of samples in one pitch period, $f(\beta)$ is a value of $\beta$-th sample in a speech wave signal within one pitch period, and $g(\gamma)$ is a value of $\gamma$-th sample in the pitch signal within the one pitch period).

3. A speech synthesizing method, the method comprising the steps of:

dividing an input speech signal into a plurality of unit speech samples;

creating a pitch wave signal from each of the unit speech samples, the pitch wave signal comprising a plurality of normalized pitch wave elements which have a substantially identical time length and uniform phase, wherein the pitch wave signal is created in such a way that a pitch signal representing pitch periods in the unit speech sample is generated and the phase of a speech wave in each pitch period is shifted so as to maximize the correlation between the speech wave in the pitch period and the pitch signal and that the phase shifted speech wave in each pitch period is resampled with the same number of samples to make uniform the time length of the speech wave in each pitch period to the same time length;

storing rhythm information representing the rhythm of each unit speech sample, pitch information representing the pitch of the sample, and spectrum information showing variation with time in the fundamental frequency component and harmonic wave component of the pitch wave signal in such a manner that each of the rhythm information, the pitch information and the spectrum information corresponds to the sample;

inputting text information representing a text is inputted to create prediction information representing the result of predicting the pitch and spectrum of a unit speech constituting the text on the basis of the text information;

identifying a sample having a pitch and spectrum having the highest correlation with the pitch and spectrum of the unit speech constituting the text on the basis of the pitch information, spectrum information and prediction information; and creating a synthesized speech signal representing a speech in which the speech has a rhythm represented by the rhythm information brought into correspondence with the identified sample, the variation with time in the fundamental frequency component and harmonic wave component is represented by the spectrum information brought into correspondence with the sample identified by the retrieval means, and the time length of one pitch period is a time length represented by the pitch information brought into correspondence with the sample identified by the retrieval means.

4. The speech synthesizing method according to claim 3, wherein the phase to be shifted of the speech wave in one pitch period has a value of $\phi$ giving the maximum cor, in accordance with the following expression:

$$cor = \sum_{i=1}^{n} \{f(i-\varphi) \cdot g(i)\}$$

(where, n is a total number of samples in one pitch period, $f(\beta)$ is a value of $\beta$-th sample in a speech wave signal within one pitch period, and $g(\gamma)$ is a value of $\gamma$-th sample in the pitch signal within the one pitch period).

* * * * *

UNITED STATES PATENT AND TRADEMARK OFFICE

CERTIFICATE OF CORRECTION

PATENT NO. : 7,647,226 B2
APPLICATION NO. : 11/715937
DATED : January 12, 2010
INVENTOR(S) : Yasushi Sato It is certified that error appears in the above-identified patent and that said Letters Patent is hereby corrected as shown below:

On the Title page item [56] of the patent, please include following text immediately before Item (51) "Int. Cl.", as follows:

Item (30) Foreign Application Priority Data

Aug. 31, 2001 (JP) ..... 2001-263395
Sep. 27, 2001 (JP) ..... 2001-298609
Sep. 27, 2001 (JP) ..... 2001-298610

Signed and Sealed this

Twenty-fifth Day of May, 2010

David J. Kappos

David J. Kappos
*Director of the United States Patent and Trademark Office*